US007455942B2

(12) United States Patent
Nagatomo et al.

(10) Patent No.: US 7,455,942 B2
(45) Date of Patent: Nov. 25, 2008

(54) TONER, DEVELOPER, TONER CONTAINER, PROCESS CARTRIDGE, IMAGE FORMING APPARATUS, AND IMAGE FORMING METHOD USING THE SAME

(75) Inventors: Tsuneyasu Nagatomo, Numazu (JP); Akihiro Kotsugai, Numazu (JP); Hiroshi Yamashita, Numazu (JP); Masayuki Ishii, Numazu (JP); Hiroto Higuchi, Machida (JP); Osamu Uchinokura, Mishima (JP); Satoshi Mochizuki, Numazu (JP); Fumihiro Sasaki, Fuji (JP); Hisashi Nakajima, Numazu (JP); Hideki Sugiura, Fuji (JP); Yasuo Asahina, Numazu (JP); Shinya Nakayama, Numazu (JP); Koichi Sakata, Numazu (JP); Tomoyuki Ichikawa, Kawasaki (JP); Takuya Saito, Numazu (JP); Sonoh Matsuoka, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 502 days.

(21) Appl. No.: 11/227,566

(22) Filed: Sep. 16, 2005

(65) Prior Publication Data

US 2006/0063081 A1 Mar. 23, 2006

(30) Foreign Application Priority Data

Sep. 17, 2004 (JP) ..... 2004-271818

(51) Int. Cl.
*G03G 9/08* (2006.01)

(52) U.S. Cl. ..... 430/108.1; 430/108.6; 430/108.7; 430/124.1; 399/252

(58) Field of Classification Search ..... 430/108.1, 430/108.6, 108.7, 124.1; 399/252
See application file for complete search history.

(56) References Cited

U.S. PATENT DOCUMENTS 6,787,280 B2 9/2004 Yamashita et al.

(Continued)

FOREIGN PATENT DOCUMENTS

JP 5-341617 12/1993

(Continued)

OTHER PUBLICATIONS

Takao Ishiyama, et al., "The characteristics of newly developed toner and the vision for the future" of The 4th Joint Symposium of The Imaging Society of Japan and The Institute of Electrostatics Japan, Jul. 29, 2002, pp. 21-28 (with partial English translation).

(Continued)

*Primary Examiner*—Mark A Chapman
(74) *Attorney, Agent, or Firm*—Oblon, Spivak, McClelland, Maier & Neustadt, P.C.

(57) ABSTRACT

It is an object of the present invention to provide a toner that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods. Therefore, provided is the toner of which the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

19 Claims, 7 Drawing Sheets

U.S. PATENT DOCUMENTS

| | | | | |
|---|---|---|---|---|
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,946,229 | B2 | 9/2005 | Suzuki et al. | |
| 2003/0049559 | A1* | 3/2003 | Shigemori et al. | 430/137.18 |
| 2004/0053154 | A1 | 3/2004 | Tomita et al. | |
| 2004/0067189 | A1 | 4/2004 | Sugiura et al. | |
| 2004/0115550 | A1 | 6/2004 | Sugiura et al. | |
| 2004/0115551 | A1 | 6/2004 | Sugiyama et al. | |
| 2004/0131961 | A1 | 7/2004 | Watanabe et al. | |
| 2004/0146795 | A1 | 7/2004 | Emoto et al. | |
| 2005/0003288 | A1 | 1/2005 | Sugiyama et al. | |
| 2005/0026064 | A1 | 2/2005 | Sugiura et al. | |
| 2005/0031980 | A1 | 2/2005 | Inoue et al. | |
| 2005/0079433 | A1 | 4/2005 | Watanabe et al. | |
| 2005/0089787 | A1 | 4/2005 | Uchinokura et al. | |
| 2005/0250036 | A1 | 11/2005 | Emoto et al. | |

FOREIGN PATENT DOCUMENTS

| | | |
|---|---|---|
| JP | 2537503 | 7/1996 |
| JP | 9-43909 | 2/1997 |
| JP | 9-258474 | 10/1997 |
| JP | 11-133667 | 5/1999 |
| JP | 2000-292973 | 10/2000 |
| JP | 2000-292978 | 10/2000 |
| JP | 3141783 | 12/2000 |

OTHER PUBLICATIONS

U.S. Appl. No. 11/687,328, filed Mar. 16, 2007, Ishii, et al.
U.S. Appl. No. 11/748,726, filed May 15, 2007, Iwata, et al.
U.S. Appl. No. 11/520,642, filed Sep. 14, 2006, Chiaki Tanaka, et al.
U.S. Appl. No. 11/558,736, filed Nov. 10, 2006, Osamu Uchinokura, et al.
U.S. Appl. No. 11/685,872, filed Mar. 14, 2007, Uchinokura, et al.
U.S. Appl. No. 11/687,875, filed Mar. 19, 2007, Kojima, et al.
U.S. Appl. No. 11/487,374, filed Jul. 17, 2006, Yamashita, et al.
U.S. Appl. No. 11/868,618, filed Oct. 8, 2007, Sugiyama, et al.
U.S. Appl. No. 11/852,778, filed Sep. 10, 2007, Nagatomo, et al.
U.S. Appl. No. 11/853,490, filed Sep. 11, 2007, Miyamoto, et al.
U.S. Appl. No. 11/857,791, filed Sep. 19, 2007, Kojima, et al.
U.S. Appl. No. 11/857,999, filed Sep. 19, 2007, Yamashita, et al.
U.S. Appl. No. 11/516,659, filed Sep. 7, 2006, Iwata, et al.
U.S. Appl. No. 11/519,057, filed Sep. 12, 2006, Nakayama, et al.
U.S. Appl. No. 11/685,969, filed Mar. 14, 2007, Uchinokura, et al.
U.S. Appl. No. 11/687,404, filed Mar. 16, 2007, Seshita, et al.
U.S. Appl. No. 12/110,055, filed Apr. 25, 2008, Sakata, et al.
U.S. Appl. No. 12/035,862, filed Feb. 22, 2008, Nagatomo, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/048,823, filed Mar. 14, 2008, Honda, et al.
U.S. Appl. No. 12/049,686, filed Mar. 17, 2008, Kotsugai, et al.
U.S. Appl. No. 12/050,502, filed Mar. 18, 2008, Yamada, et al.
U.S. Appl. No. 12/046,011, filed Mar. 11, 2008, Nagatomo, et al.
U.S. Appl. No. 12/047,807, filed Mar. 13, 2008, Honda, et al.

* cited by examiner

TONER, DEVELOPER, TONER CONTAINER, PROCESS CARTRIDGE, IMAGE FORMING APPARATUS, AND IMAGE FORMING METHOD USING THE SAME

BACKGROUND OF THE INVENTION

1. Field of the Invention

The present invention relates to toner for developing the electrostatic images of electrophotography, electrostatic recording, electrostatic printing, and the like, developer, toner container, process cartridge, image forming apparatus and image forming method using the toner.

2. Description of the Related Art

In an electrophotographic apparatus or electrostatic recording apparatus, a latent electrostatic image is formed on a photoconductor, to which toner is attached. The toner is transferred to a transfer material, and then fixed to the transfer material by heat to form a toner image. A full-color image formation, a reproduction of colors, is generally done by using toners of four different colors consisting of black, yellow, magenta, and cyan. Development is carried out for each color, and the toner image made up of each toner layer overlaid on the support material is then heated and fixed simultaneously to obtain a full-color image.

In general, for a user who is accustomed to commercial prints, images created by full-color copiers are still not at a satisfactory level, and demands are high for further improving the quality to achieve the fineness and resolution that are comparable to those of photographic and offset prints. It is known that in order to improve the quality of an electrophotographic image, the diameters of toner particles should be small and the distribution of particle diameter should be narrow.

A latent image, either electric or magnetic, is made visible by toner. Toners used for developing an electrostatic image generally include colored particles comprising a colorant, a charge controlling agent, and other additives in a binder resin. Processes for manufacturing toner can be categorized broadly into pulverization and polymerization. Pulverization is a process in which a colorant, a charge controlling agent, an offset preventing agent, and the like are melted, mixed, and evenly dispersed in a thermoplastic resin, after which an obtained toner composition is crushed into small particles and classified to obtain a toner.

With pulverization, toners having somewhat favorable properties can be manufactured, but materials that can be used for toners are limited. For instance, a composition made by melting and mixing the components must be crushed and classified using an apparatus that is economically affordable. For this requirement, the composition should be sufficiently brittle. Therefore, when the composition is actually crushed into particles, the distribution of particle diameters tends to be wide spread. The drawback is that the yield is extremely low when one tries to obtain a reproduced image having favorable tone and resolution because a portion of the toner particles, for example, minute particles of 5 μm or less in diameter and large grains of 20 μm or more, must be removed by classification. In addition, it is difficult in pulverization to evenly disperse a colorant, a charge controlling agent, and the like within a thermoplastic resin. Uneven dispersion of the agents and additives adversely affect the flowability, developability, durability, image quality, and the like of toners.

To overcome such problems in pulverization, toner particles are recently made by other processes such as suspension polymerization (Japanese Patent Application Laid-Open (JP-A) No. 09-43909). However, toner particles manufactured by suspension polymerization have a drawback of poor cleaning ability although they are spherical. For development and transfer of low toner coverage image, there is little residual toner that is not transferred and therefore there is no concern of insufficient cleaning of toner. However, when the toner coverage of an image is high, e.g. a photographic image, a paper jam or the like may result in building up of non-transferred residual toner on a photoconductor on which toner is forming an image but not transferred. Accumulation of such residual toner leads to background smear. Moreover, residual toner contaminates components such as a charging roller, which charges a photoconductor by contact charging, and subsequently reduces the charging performance of the charging roller. Furthermore, concerns for toner particles formed by suspension polymerization include unsatisfactory fixing property at low temperatures and a large amount of energy required for fixing.

On the other hand, another process for manufacturing toner particles is disclosed in Japanese Patent (JP-B) No. 2537503 in which emulsion polymerization is used to form resin fine particles, which are subsequently associated to obtain toner particles having irregular shapes. However, toner particles formed by emulsion polymerization have residual surfactants inside the particles as well as on the surface thereof, even after being washed by water, which reduces the environmental stability of toner charge, increases the distribution of the amount of charge, and causes background smear on a printed image. In addition, the residual surfactant contaminates photoconductor, charging roller, developing roller, and other components causing problems such as insufficient charging performance.

On the other hand, for the fixing process by contact heating, in which heating members such as a heating roller are used, the toner particles must possess releasability, which may be referred to as "offset resistance" hereinafter, from the heating members. In such case, offset resistance can be improved by allowing a releasing agent to exist on the surface of toner particles. In contrast, methods to improve offset resistance are disclosed in JP-A No. 2000-292973 and JP-A No. 2000-292978 in which resin fine particles are not only contained in toner particles, but are concentrated at the surface of the toner particles. However, this approach brings up an issue in which the method increases the lowest possible temperature at which toner is fixed and therefore is unsatisfactory in fixing ability at low temperature, i.e. energy-saving fixing ability.

In addition, this process, in which resin fine particles obtained by emulsion polymerization are associated to provide irregular-shaped toner particles, has another problem. Generally, releasing agent particles are additionally associated to improve the offset resistance. However, the releasing agent particles are captured inside the toner particles and therefore the improvement of the offset resistance is not sufficient. Moreover, since each toner particle is formed by a random adhesion of molten resin fine particles, releasing agent particles, colorant particles, and the like, the composition (the ratio at which each component is contained), molecular mass of the resin, and the like may be different and dispersed for each obtained toner particle. In result, the surface properties of toner particles are different from one another, and it is impossible to form stable images for a long period. Additionally, in a low-temperature fixing system, the resin fine particles that are concentrated at the surface of the toner particles inhibit fixing and therefore the range of fixing temperature is not sufficient.

Recently, a new manufacturing process called emulsion-aggregation (EA) has been suggested (JP-B No. 3141783). In this process, particles are formed from polymers that are dissolved in an organic solvent or the like whereas in suspension polymerization, particles are formed from monomers, and it is said to be advantageous in that, for example, there is a larger selection of resins that can be used and polarity can be controlled. Furthermore, it is said to be advantageous in that it is possible to control the structure of toner particles (core/shell structure control). However, the shell structure is a layer consisting only of a resin and the purpose thereof is to lower the exposure of pigment and wax to the surface. The purpose is not to alter the structure in the resin, and the structure is not capable for such purpose, as outlined in "The characteristics of newly developed toner and the vision for the future" by Takao Ishiyama, and two others from The 4$^{th}$ Joint Symposium of The Imaging Society of Japan and The Institute of Electrostatics Japan on Jul. 29, 2002. Therefore, although the toner particle has a shell structure, the surface of the toner particle is a usual resin without any ingenious feature so that when the toner particle is targeted at fixing at a lower temperature, it is not satisfactory from the standpoint of anti-heat preservability and environmental charge stability and this is a concern.

In any of the above-mentioned processes, suspension polymerization, emulsion polymerization, and emulsion aggregation, styrene-acrylic resins are generally used. Polyester resins are difficult to be made into particles, and it is uneasy to control particle diameter, diameter distribution, and particle shape. Also, their fixing ability is limited when the aim is to be fixed at a lower temperature.

On the other hand, it is known that polyester modified by urea bonds is used for anti-heat preservability and low-temperature fixing (JP-A No. 11-133667). However, this has no ingenious feature administered on the surface, and the environmental charge stability is not satisfactory especially when the conditions are harsh.

Much work has been done from various angles of approach in the field of electrophotography to improve quality, and it is being recognized that it is extremely effective to reduce the size and increase the sphericity of the toner particle. However, as the diameter of toner particles becomes smaller, the transferability and fixing ability tend to decrease, and image quality becomes poor. On the other hand, it is known that by making toner particles round, the transferability rises (JP-A No. 09-258474). In such situation, ever-faster image production is desired in the field of color copiers and printers. For a faster printing, the "tandem method" is effective as disclosed, for example, in JP-A No. 05-341617.

The "tandem method" is a method in which images formed by respective image forming units are overlaid and sequentially transferred onto a sheet of paper that is advanced by a transfer belt so that a full-color image is obtained on the sheet. A color image forming apparatus using tandem method is characteristic in that various kinds of paper can be used, the quality of full-color images are high, and full-color images can be formed at high speed. The high-speed output of full-color images is especially characteristic and no other color image reproduction machines have that characteristic.

There are other attempts to increase speed while improving the quality by using round toner particles. For example, since chemical-like round toner particles form compactly developed toner images on the photoconductor, and the transfer pressure at the time of transfer is evenly imposed onto the toner layer, transfer failures such as transfer yield decrease or dropouts of transfer images is less than that of pulverized toner. However, compared to the pulverized toner in the use over time, the flowability improver added to improve transferability and to give flowability to toner becomes rapidly immersed into a toner surface, radically changing the transferability and flowability. Especially when outputting images with small dimension, in other words, images consuming less toner, in succession, the external additives within toner become immersed in the use over time, withering the effect of improving flowability, and therefore resulting in varied transferability and causing problems such as noticeable nonuniformity over the images, etc. in the present circumstances.

SUMMARY OF THE INVENTION

It is an object of the present invention to provide a toner, a developer, a toner container, a process cartridge, an image forming apparatus, and an image forming method using the toner that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods.

From a dedicated investigation that has been carried out to settle above issues, it is found that the aggregate of external additives inside the toner, whether being overfull or scarce, is undesirable for enhancing toner capability, and by controlling a quantity of aggregate of external additives to be within a specified range, a toner that can sustain favorable transferability and cleaning ability for prolonged periods; prevents photoconductor filming; exhibits no variation in image nonuniformity or external additive immersion induced by developer agitation at the time of use; excels in stability with flowability and charge stability having over prolonged periods can be produced.

The toner of the present invention comprises an external additive that contains large diameter particles and small diameter particles of which the volume average particle diameter is smaller than that of large diameter particles. The quantity of aggregates of residual external additive found on a sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

As a result, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods can be produced.

Because developer of the present invention comprises toner of the present invention, if an image formation is performed by electrophotographic method using the developer, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

Because toner container of the present invention comprises toner of the present invention, if an image formation is performed by electrophotographic method using the toner comprised in the toner container, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

The process cartridge of the present invention comprises a latent electrostatic image bearing member and a developing unit configured to develop a latent electrostatic image on the latent electrostatic image bearing member using a toner to form a visible image. Because the process cartridge is conveniently detachable onto/from the image forming apparatus and uses toner of the present invention, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

The image forming apparatus of the present invention comprises a latent electrostatic image bearing member, a latent electrostatic image forming unit configured to form the latent electrostatic image on the latent electrostatic image bearing member, a developing unit configured to develop the latent electrostatic image using the toner of the invention to form a visible image, a transferring unit configured to transfer the visible image onto a recording medium and a fixing unit configured to fix the transferred image on the recording medium. In the image forming apparatus, the latent electrostatic image forming unit forms a latent electrostatic image on the latent electrostatic image bearing member. The transferring unit transfers the visible image onto the recording medium. The fixing unit fixes the transfer image onto the recording medium. As a result, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

An image forming method comprises forming a latent electrostatic image on a latent electrostatic image bearing member, developing the latent electrostatic image using a toner of the present invention to form a visible image, transferring the visible image onto a recording medium and fixing the transferred image on the recording medium. In the image forming method, the latent electrostatic image is formed on the latent electrostatic image bearing member in the latent electrostatic image forming. The visible image is transferred onto the recording medium in the transferring. The transferred image is fixed on the recording medium in the fixing.

As a result, high quality images that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

DESCRIPTION OF THE PREFERRED EMBODIMENTS (Toner)

Figure 1:
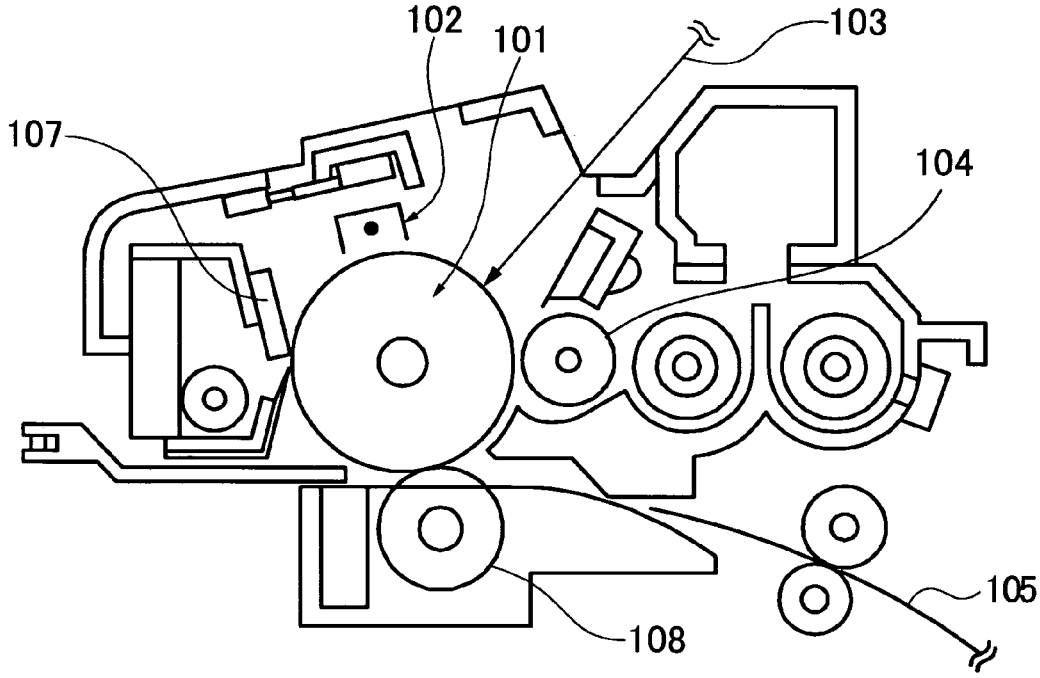
FIG. 1 is a schematic diagram of an example of the process cartridge of the present invention.

The toner of the present invention comprises an external additive that contains large diameter particles, small diameter particles of which a volume average particle diameter is smaller than that of the large diameter particles and other elements as necessary.

The quantity of aggregates of residual external additives found on a sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more, preferably 4,500 or less and 20 or more, more preferably 3,000 or less and 30 or more, most preferably 2,500 or less and 40 or more.

(1) When external additives, specifically the external additives containing large diameter particles of which the volume average particle diameter is 80 nm to 250 nm, are produced by wet method, the particle size distribution may be sharp, but many aggregates that are possibly produced in the drying process exist. Since these aggregates of external additives exist while being isolated from the toner, they are rasped and stretched mainly by the cleaning blade on the photoconductor and cause filming. Such inorganic particles absorb polar substances in the air and become a leak source of latent-image potential which leads to defocused images.

In the present invention, by using toner of which the quantity of aggregates of residual external additives on the sieve is controlled so that they remain 4,500 or less, filming can be prevented to produce crisp and high quality images.

On the other hand, (2) by mixing aggregates of external additives, specifically the external additives containing large diameter particles of which the volume average particle diameter is 80 nm to 250 nm, into a small amount of toner, the aggregates of large diameter particles within toner become gradually cracked corresponding to the agitation time of developer, and become attached to the toner surface. This let the large diameter particles to be slightly immersed and another large diameter particles are fleshly supplied in the place of those that are no longer effective for enhancing flowability due to the change in flowability of toner or the displacement within toner; thus enabling long-period sustainment of transferability leading to the production of uniform images not depending on the dimension of output images.

In the present invention, by controlling the quantity of aggregates of residual external additives on the sieve to be 5 or more, favorable transferability and cleaning ability can be sustained for prolonged periods.

By controlling the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, to be 4,500 or less and 5 or more, the toner that can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods, can be produced.

For measuring the quantity of aggregate of external additives, for example, 0.2 g of toner is weighed on a V-blowing cell, a sieve of 635-mesh and 452 $cm^2$ of mesh area, and blasted at a blow pressure of 0.2 MPa from 160 mm above the cell while air-sucking at a suction force of 5 mmHg to remove toner. Additional removal of toner is then performed by air-sucking at a suction force of 20 mmHg. If the toner removal is incomplete, the same procedure is taken in succession to complete the toner removal. The residuals on the sieve are then observed by digital microscope (KEYENCE VHX-100) at 150 magnifications. The quantity of aggregate (white aggregate particles of about 30 μm) of residual external additives on the sieve is counted. 4 to 20-scope measurement is made to obtain the body mass of the aggregate of external additives contained in the toner.

The volume average particle diameter of large diameter particles is preferably 80 nm to 250 nm, more preferably 90 nm to 200 nm and most preferably 100 nm to 150 nm. If the volume average particle diameter is less than 80 nm, external additives are more likely to be immersed into the toner and may be ineffective in decreasing non-electrostatic adherence. If the volume average particle diameter is more than 250 nm, it is more likely to migrate into the contact-carrying members by the separation of large diameter particles from the toner.

The volume average particle diameter of small diameter particles is not particularly limited and may be adjusted accordingly and it is preferably 5 nm to 50 nm.

In the present invention, by using external additive particles of different diameter, rotary motion of the toner is suppressed and excessive packing of the toner can be prevented even though the toner shape is practically round, enabling to sustain cleaning ability and transferability in favorable condition. Furthermore, because developer agitation over prolonged periods can prevent selective immersion of fine powder with small diameter into the toner, it is possible to obtain stable flowability for prolonged periods.

Of these two kinds of particles, the large diameter particles are relatively less effective in terms of improving toner flowability. For example, the toner with small diameter particles exhibits dramatically high flowability compared to the toner with large diameter particles even though the content of each particle in the toner is equivalent. However, with only small diameter particles, external additives are more likely to be immersed into the toner and may cause flowability degradation in the use over time. In contrast, adding large diameter particles can suppress the flowability degradation over time, however, majority of large diameter particles have problems such as detachment from the toner in developer agitation or disability of appropriate attachment on the toner when mixed. Also, the transferability fluctuation in use over time may somewhat improve compared to the toner with only small diameter particles, however, it is not sufficient. Specifically, when outputting images in different dimension, transferability varies depending on the time of developer agitation and accumulation of toner in the developer. This is caused by the gradual immersion of large diameter particles within toner similar to small diameter particles where evenly mixed large diameter particles on the toner surface become concentrated and accumulated in the small asperity of the surface unable to express favorable effects expected.

Adding large diameter particles prior to adding small diameter particles is preferable for enhancing cracking effect of aggregated body of large diameter particles because of relatively low flowability of large diameter particles compared to that of the small diameter particles. This can also prevent a mass volume isolation of large diameter particles and implement uniform dispersion of external additives of large diameter particles in the toner surface.

It is preferable to give dry addition in which external additives and toner particles are mixed and the external additives are attached to the toner particles.

In the dry addition, because absolute specific gravity of external additives in general is large and the external additives exist in an aggregated form, they tend to separate from the toner-base particles. This may become more notable depending on the particle diameter. In other words, characteristically, small diameter particles tend to attach to the toner-base particles and large diameter particles are difficult to attach and tend to separate from the toner-base particles. Because of this, when these external additives are added simultaneously, small diameter particles are selectively attached first, letting large diameter particles to exist isolated, therefore not preferable. External additives attached to the toner-base particles after passing through the mixing process where aggregated external additives are cracked, dispersed and attached to the surface of toner-base particles, are assumed to be fixed by the friction between toner particles and the clash with the wall inside the apparatus. If the small diameter particles are added first, it improves flowability of the toner particles making it difficult to obtain sufficient shearing for the attachment of the large diameter particles, and allow them to be isolated and therefore not preferable. From the various studies for adding methods, it is found that mixing toner-base particles and large diameter particles first, would work favorably. Also, mixing in toner-base particles after stirring only external additives is effective. Mixing can be done by known mixers such as V-type blender, HENSCHEL MIXER, hybridizer, and the like.

The circumferential velocity of rotating body of these mixers is preferably 10 m/s to 150 m/s. If the circumferential velocity is less than 10 m/s, aggregated body of external additives are not completely cracked and takes long time for cracking therefore inefficient. If the circumferential velocity is more than 150 m/s, external additives may be fixed to the toner-base particles too much making it impossible to function as external additives.

It is preferable to give wet addition in which external additives and toner particles are dispersed in an aqueous medium and the external additives are attached to the toner particles. In the wet addition, large diameter particles are dispersed in the liquid where cracking aggregation is easily done compared to the addition within gas (dry addition), and reaches the quantity level of cracked aggregated body of external additives needed for the invention.

When using dry toner for wet addition, toner-base particles may be dispersed in water using surfactant, etc. prior to wet addition if required. When toner particles are formed in water, it is preferable to give wet addition after eliminating the surfactant by cleansing. The excess amount of surfactant in water is eliminated by operating solid-liquid separation such as filtration or centrifugation and obtained cake and slurry are dispersed again in an aqueous medium.

Furthermore, inorganic particles are added and dispersed in the slurry. Alternatively, inorganic particles may be dispersed in an aqueous dispersing element in advance. In this regard, by dispersing by means of a surfactant, having reverse polarity of the surfactant used for making aqueous dispersing element of the toner-base particle, attachment to the surface of toner particles would be done more efficiently. When inorganic particles are being hydrophobized and it is difficult to disperse in the aqueous dispersing element, the dispersion may be done after lowering the interfacial tension with a simultaneous use of small amount of alcohol, etc.

Then an aqueous solution of antipolaric surfactant is added gradually while stirring. The amount of antipolaric surfactant used is preferably 0.01% by mass to 1% by mass relative to the solid content of the toner. The charge of dispersing element of inorganic particles in water is neutralized by adding antipolaric surfactant and aggregation attachment of inorganic particles to the surface of toner particles become possible.

Instead of gradually adding aqueous solution of antipolaric surfactant while stirring, inorganic particles can be attached by oxidizing or alkalizing pH of the dispersal system.

The inorganic particles attached to the toner surface become fixed on the toner surface by heating slurry afterward to prevent separation. In this regard, it is preferable to heat up slurry at a temperature higher than glass-transition temperature (Tg) of the resin constructing toner. The heat treatment may be done after being dried while preventing aggregation.

Furthermore, a dispersing element of charge controlling agent particles may be contained in the redispersed slurry for the purpose of reinforcing charging ability. Generally, charge controlling agents are in a form of fine particles; however, dispersing element of particles can be obtained by dispersing in the aqueous medium using surfactants used for producing toner particles in the aqueous medium or antipolaric surfactants added for charging. By adding antipolaric surfactants, the electric charge of dispersing element of the charge controlling agent particles is neutralized and aggregation attachments of inorganic particles to the surface of toner particles become possible.

The charge controlling agent is preferably a dispersing element of 0.01 μm to 1 μm of particle diameter and may be used in the amount of 0.01% by mass to 5% by mass relative to the solid content of toner particles.

Furthermore, a dispersing element of resin fine particles may be contained in the redispersed slurry for the purpose of reinforcing charging ability. By adding antipolaric surfactants, the electric charge of dispersing element of the resin fine particles is neutralized and aggregation attachments of inorganic particles to the surface of toner particles become possible.

The resin fine particles may be used in the amount of 0.01% by mass to 5% by mass relative to the solid content of toner particles.

The particles generally used for the purpose of providing flowability or charging ability may be used as external additives containing large diameter particles and small diameter particles, and examples thereof are oxidized particles, inorganic particles and hydrophobized particles, etc.

External additives are not limited and may be selected from known external additives accordingly and examples include silica particles, hydrophobized silica, fatty acid metal salt such as zinc stearate, aluminum stearate, and the like, metal oxide such as titania, alumina, tin oxide, antimony oxide, and the like, and fluoro polymers. Of these, large diameter particles are preferably silica particles of 80 nm to 150 nm of volume average particle diameter and the small diameter particles are preferably one of titanium oxide or hydrophobized silica particles.

Examples of silica particles include HDK H2000, HDK H2000/4, HDK H2050EP, HVK21, HDK H1303 by Hochst; R972, R974, RX200, RY200, R202, R805, R812 by Nippon Aerosil Co., Ltd.

Examples of titania particles include P-25 by Nippon Aerosil Co., Ltd.; STT-30, STT-65C-S by Titan Kogyo Kabushiki Kaisha; TAF-140 by Fuji Titanium Industry Co., Ltd.; MT-150W, MT-500B, MT-600B, MT-150A by Tayca Corporation.

Examples of hydrophobized titanium oxide particles include T-805 by Nippon Aerosil Co., Ltd.; STT-30A and STT-65S-S by Titan Kogyo Kabushiki Kaisha; TAF-500T and TAF-1500T by Fuji Titanium Industry Co., Ltd.; MT-100S and MT-100T by Tayca Corporation; IT-S by Ishihara Sangyo Kaisha Ltd.

Hydrophobized oxide particles, silica particles, titania particles and alumina particles can be obtained by treating hydrophilic particles with silane coupling agent such as methyl trimethoxy silane, methyl toriethoxy silane or octyl trimethoxy silane, and the like. If silicone oil is needed, silicone oils treated by heat to form inorganic particles such as silicone oil-treated oxide particles and inorganic particles are suitably used.

Examples of silicone oil include dimethyl silicone oil, methylphenyl silicone oil, chlorphenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether modified silicone oil, phenol-modified silicone oil, carboxyl-modified silicone oil, mercaptol-modified silicone oil, acryl-methacryl modified silicone oil and α-methylstyrene-modified silicone oil.

Specific examples of inorganic particles include silica, alumina, titanium oxide, barium titanate, magnesium titanate, calcium titanate, strontium titanate, iron oxide, copper oxide, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide and silicon nitride. Among them, silica and titanium dioxide are especially preferable.

Examples of other polymeric particles include polystyrene obtained by soap-free emulsion polymerization, suspension polymerization or dispersion polymerization, methacrylic acid ester or acrylic acid ester copolymers, condensation polymers such as silicone, benzoguanamine and nylon, and polymeric particles obtained from thermoset resins.

If these fluidizers are surface-treated to increase hydrophobicity, degradation of flowability or charging ability can be prevented even under a high humidified condition. Examples of suitable surface treatment agents include silane coupling agents, silyl agents, silane coupling agents having fluorinated alkyl group, organic titanate coupling agents, aluminium coupling agents, silicone oils and modified silicone oils.

Examples of cleaning ability improver for removing residual developer on the photoconductor or primary transferring medium after transferring process include fatty acid metal salts such as zinc stearate, calcium stearate, stearic acid, and the like; polymeric particles manufactured by soap-free emulsion polymerization or the like such as polymethylmethacrylate particles, polystyrene particles; and the like. The polymeric particles preferably have a relatively narrow particle size distribution, and a volume average particle diameter of 0.01 μm to 1 μm.

The content of large diameter particles in the toner is preferably 0.1% by mass to 5% by mass. The content of small diameter particles in the toner is preferably 0.5% by mass to 5% by mass. And the content of large diameter particles is preferably less than the content of small diameter particles.

Manufacturing process and substances of toner are not limited as long as fulfilling above conditions and may be selected accordingly. It is preferably the toner close to spherical form of small diameters to output high quality, high resolution images, for example. Examples of manufacturing process include pulverization classification, suspension polymerization, emulsification polymerization, polymer suspension, etc. in which oil phase is emulsified, suspended or aggregated in an aqueous medium to form toner-base particles.

The pulverization is a process in which toner-base particles are produced by melt-blending, pulverizing and classifying toner substances. In the pulverization, the form of toner-base particles can be controlled by giving mechanical impact to make an average circularity of toner to be within a range of 0.97 to 1.0. The force of mechanical impact may be, for example, given to the toner-base particles by apparatuses such as Hybritizer or Mechanofusion, etc.

In suspension polymerization process, oil-soluable polymerization initiator, colorant and releasing agent, etc. are dispersed in the polymerizable monomer and emulsified and dispersed in an aqueous medium containing surfactant and other solid dispersants by the emulsion process described later. After making into particles by polymerization reaction, wet treatment is performed by which inorganic particles are attached to the surface of toner particles. The wet treatment is preferably performed on the toner particles of which excess surfactant has been cleaned and eliminated.

Examples of polymerizable monomer include acids such as acrylic acid, methacrylic acid, α-cyanoacrylic acid, α-cyanomethacrylic acid, itaconic acid, crotonic acid, fumaric acid, maleic acid, maleic anhydride, or the like; acrylamide, methacrylamide, diacetone acrylamide, methyloyl compounds thereof, or the like; acrylate, methacrylate having amine group such as vinyl pyridine, vinyl pyrrolidine, vinyl imidazole, ethyleneimine, dimethylaminoethyl methacrylate, or the like. By using part of above monomers, functional groups may be introduced into the surface of toner particles.

Furthermore, by selecting dispersant having acid group or salt base group, the dispersant may be survived by absorbtion on the particle surface and the functional group may be introduced.

In emulsion polymerization, water-soluable polymerization initiator and polymerizable monomer are emulsified in water by using surfactant and latex is synthesized by normal emulsion polymerization process. Other dispersing element in which colorant and releasing agent, etc. are dispersed in an aqueous medium is prepared and the toner is produced by aggregating into a size of toner followed by heat-fusion after mixing. And then the wet treatment of inorganic particles described later is performed. The functional group may be introduced into the surface of toner particles by using same monomers that may be used as latex for suspension polymerization process.

In the invention, because of high selectivity of resin, high fixability at low temperature, excellent ability to become particles and easily controlled particle diameter, particle size distribution and form, the toner produced after toner solution is regulated by fusing and dispersing toner substance containing active hydrogen group-containing compounds and reactive polymers thereof in an organic solvent, the dispersion is regulated by emulsification and dispersion of toner solution into an aqueous medium, the adhesive base material is reduced into particles by reaction between active hydrogen group-containing compounds and reactive polymers thereofs in the aqueous medium and the organic solvent is eliminated, is preferable.

The toner substance contains at least active hydrogen group-containing compounds and reactive polymers thereofs, binding resin, releasing agent, adhesive base material produced by reaction with colorant, and other element such as resin fine particles, charge controlling agent, and the like as necessary.

-Adhesive Base Material-

The adhesive base material may exhibit adhesiveness with recording medium such as paper and contain adhesive polymer produced from a reaction between active hydrogen group-containing compounds and reactive polymers thereof and may also contain binding resin selected from known binding resins.

The average molecular mass of adhesive base material is not particularly limited and may be adjusted accordingly and it is preferably 1,000 and more, more preferably 2,000 to 10,000,000 and most preferably 3,000 to 1,000,000.

If the average molecular mass is less than 1,000, hot offset resistance may be deteriorated.

The storage modulus of adhesive base material is not particularly limited and may be selected accordingly. For example, the temperature TG', at which the storage modulus determined at 20 Hz is 10,000 dyne/cm$^{2}$, is normally 100° C. or more and preferably from 110° C. to 200° C. If the temperature TG' is less than 100° C., hot offset resistance may be deteriorated.

The viscosity of adhesive base material is not particularly limited and may be selected accordingly. For example, the temperature Tη, at which the viscosity determined at 20 Hz is 10,000 poises, is normally 180° C. or less and preferably from 90° C. to 160° C. If the temperature (Tη) is more than 180° C., fixing ability at low temperature may be deteriorated.

From the viewpoint of simultaneous pursuit of hot offset resistance and fixing ability at low temperature, the temperature TG' is preferably higher than the temperature Tη. Specifically, the difference between TG' and Tη is preferably 0° C. or more, and more preferably 10° C. or more and most preferably 20° C. and more. The higher the difference, the better the effect will be.

From the viewpoint of simultaneous pursuit of hot offset resistance and fixing ability at low temperature, the difference between TG' and Tη is preferably from 0° C. to 100° C., more preferably from 10° C. to 90° C. and most preferably from 20° C. to 80° C.

Specific examples of adhesive base material are not particularly limited and may be selected accordingly. Suitable examples thereof are polyester resin, and the like.

The polyether resin is not particularly limited and may be selected accordingly. Suitable examples thereof are urea-modified polyester, and the like.

The urea-modified polyester is obtained by a reaction between amines (B) as an active hydrogen group-containing compound, and isocyanate group-containing polyester prepolymer (A) as a polymer reactive with active hydrogen group-containing compound in the aqueous medium.

In addition, the urea-modified polyester may include a urethane bond as well as a urea bond. A molar ratio of the urea bond content to the urethane bond content is preferably 100/0 to 10/90, more preferably 80/20 to 20/80, and most preferably 60/40 to 30/70. If a molar ratio of the urea bond is less than 10%, hot-offset resistance may be deteriorated.

Specific examples of the urea-modified polyester are preferably the following (1) to (10): (1) A mixture of (i) polycondensation product of bisphenol A ethyleneoxide dimole adduct and isophthalic acid, and (ii) urea-modified polyester prepolymer which is obtained by reacting isophorone diocyanate with a polycondensation product of bisphenol A ethyleneoxide dimole adduct and isophtalic acid, and modifying with isophorone diamine; (2) A mixture of (iii) a polycondensation product of bisphenol A ethyleneoxide dimole adduct and terephthalic acid, and (ii) urea-modified polyester prepolymer which is obtained by reacting isophorone disocyanate with a polycondensation product of bisphenol A ethyleneoxide dimole adduct and terephthalic acid, and modifying with isophorone diamine; (3) A mixture of (iv) polycondensation product of bisphenol A ethyleneoxide dimole adduct, bisphenol A propyleneoxide dimole adduct and terephthalic acid, and (v) urea-modified polyester prepolymer which is obtained by reacting isophorone disocyanate with polycondensation product of bisphenol A ethyleneoxide dimole adduct, bisphenol A propyleneoxide dimole adduct and terephthalic acid, and modifying with isophorone diamine; (4) A mixture of (vi) polycondensation product of bisphenol A propyleneoxide dimole adduct and terephthalic acid, and (v) urea-modified polyester prepolymer which is obtained by reacting isophorone disocyanate with polycondensation product of bisphenol A ethyleneoxide dimole adduct, bisphenol A propyleneoxide dimole adduct and terephthalic acid, and modifying with isophorone diamine; (5) A mixture of (iii) polycondensation product of bisphenol A ethyleneoxide dimole adduct and terephthalic acid, and (vi) urea-modified polyester prepolymer which is obtained by reacting isophorone disocyanate with polycondensation product of bisphenol A ethyleneoxide dimole adduct and terephthalic acid, and modifying with hexamethylene diamine; (6) A mixture of (iv) polycondensation product of bisphenol A ethyleneoxide dimole adduct, a bisphenol A propyleneoxide dimole adduct and terephthalic acid, and (vi) urea-modified polyester prepolymer which is obtained by reacting isophorone disocyanate with polycondensation product of bisphenol A ethyleneoxide dimole adduct and terephthalic acid, and modifying with hexamethylene diamine; (7) A mixture of (iii) polycondensation product of bisphenol A ethyleneoxide dimole adduct and terephthalic acid, and (vii) urea-modified polyester prepolymer which is obtained by reacting isophorone disocyanate with polycondensation product of bisphenol A ethyleneoxide dimole adduct and terephthalic acid, and modifying with ethylene diamine; (8) A mixture of (i) polycondensation product of bisphenol A ethyleneoxide dimole adduct and isophthalic acid, and (viii) urea-modified polyester prepolymer which is obtained by reacting diphenylmethane disocyanate with polycondensation product of bisphenol A ethyleneoxide dimole adduct and isophthalic acid, and modifying with hexamethylene diamine; (9) A mixture of (iv) polycondensation product of bisphenol A ethyleneoxide dimole adduct, bisphenol A propyleneoxide dimole adduct, terephthalic acid and dodecenylsuccinic anhydride, and (ix) urea-modified polyester prepolymer which is obtained by reacting diphenylmethane disocyanate with polycondensation product of bisphenol A ethyleneoxide dimole adduct, bisphenol A propyleneoxide dimole adduct, terephthalic acid and dodecenylsuccinic anhydride, and modifying with hexamethylene diamine; (10) A mixture of (i) polycondensation product of bisphenol A ethyleneoxide dimole adduct and isophthalic acid, and (x) urea-modified polyester prepolymer which is obtained by reacting toluene disocyanate with polycondensation product of bisphenol A ethyleneoxide dimole adduct and isophthalic acid, and modifying with hexamethylene diamine.

--Active Hydrogen Group-Containing Compound--

The active hydrogen group-containing compound functions as an elongation initiator or crosslinking agent at the time of elongation reactions or crosslinking reactions with the polymer reactive with aforesaid compounds in the aqueous medium.

The active hydrogen group-containing compounds are not particularly limited as long as containing active hydrogen group, and may be selected accordingly. For example, if a polymer reactive with the active hydrogen group-containing compounds is an isocyanate group-containing polyester prepolymer (A), from the viewpoint of ability to increase molecular mass by reactions such as elongation reaction, crosslinking reaction, or the like, amines (B) may be suitably used.

Active hydrogen groups are not particularly limited and may be selected accordingly. Examples include hydroxyl groups such as alcoholic hydroxyl group and phenolic hydroxyl group, amino groups, carboxyl groups, mercapto groups, and the like. These may be used alone or in combination. Of these, alcoholic hydroxyl group is especially preferable.

The amines (B) are not particularly limited and may be selected accordingly. Examples of amines (B) include diamine (B1), polyamine having 3 or more valence (B2), amino alcohol (B3), amino mercaptan (B4), amino acid (B5), block compound in which the amino group of (B1) to (B5) is blocked (B6), and the like.

These may be used alone or in combination. Of these, diamine (B1) and a mixture of diamine (B1) with a small amount of polyamine having 3 or more valence (B2) are especially preferable.

Examples of diamine (B1) include aromatic diamine, alicyclic diamine and aliphatic diamine. Examples of aromatic diamine are phenylene diamine, diethyltoluene diamine, 4,4'-diaminophenylmethane, and the like. Examples of alicyclic diamine are 4,4'-diamino-3,3'-dimethyldicycrohexylmethane, diamine cyclohexane, isophorone diamine, and the like. Examples of aliphatic diamine are ethylene diamine, tetramethylene diamine, hexamethylene diamine and the like.

Examples of polyamine having 3 or more valence (B2) include diethylene triamine, triethylene tetramine, and the like.

Examples of amino alcohol (B3) include ethanolamine, hydroxyethylaniline and the like.

Examples of amino mercaptan (B4) include aminoethylmercaptan, aminopropylmercaptan, and the like.

Examples of amino acid (B5) include amino propionic acid, amino capric acid, and the like.

Examples of block compound in which the amino group of (B1) to (B5) is blocked (B6) include ketimine compound, oxazoline compound, and the like obtained from amines and ketones of (B1) to (B5) such as acetone, methylethylketone, methylbutylketone and the like.

A reaction terminator may be used to stop elongation reaction, crosslinking reaction, or the like between active hydrogen group-containing compound and polymers reactive with the compound. It is preferable to use reaction terminator because it enables to control molecular mass of adhesive base material within a preferable range. Examples of reaction terminator include monoamine such as diethylamine, dibutylamine, butylamine, laurylamine, and the like, block compounds in which these monoamines are blocked such as ketimine compound, or the like.

The mixture ratio of amines (B) and the isocyanate group-containing prepolymer (A), in terms of mixture equivalent ratio of isocyanate group [NCO] in the isocyanate group-containing prepolymer (A) and amino group [NHx] in the amines (B), [NCO]/[NHx], is preferably from 1/3 to 3/1, more preferably from 1/2 to 2/1 and most preferably from 1/1.5 to 1.5/1. When the mixture equivalent ratio [NCO]/[NHx] is less than 1/3, fixing ability at low temperature may deteriorate, and when it is more than 3/1, the molecular mass of urea-modified polyester becomes low, possibly imparing hot offset resistance.

--Active Hydrogen Group-Containing Compound and Polymer Reactive-- with Aforesaid Compounds Active hydrogen group-containing compound and the polymer reactive with the compound are not particularly limited as long as they contain at least a reactive site with active hydrogen group-containing compound and may be selected from known resins, etc. accordingly. Examples of active hydrogen group-containing compound and the polymer reactive with the compound include polyol resin, polyacryl resin, polyester resin, epoxy resin, derivative resins thereof, and the like.

These may be used alone or in combination. Of these, from the view point of having high flowability and transparency in the fusing process, polyester resin is especially preferable.

A reactive site with active hydrogen group-containing compounds of the prepolymer is not particularly limited and may be selected from known substituents accordingly. Examples of substituents include isocyanate group, epoxy group, carboxylic acid, acid chloride group, and the like.

These may be used alone or in combination. Of these, isocyanate group is especially preferable.

Among prepolymers, polyester resin containing urea bond formation group (RMPE) is especially preferable, because it is easy to control the molecular mass of polymer elements and has oilless fixing ability at low temperature, as well as ability to sustain favorable releasing and fixing abilities even when it lacks releasing oil coating system for the heating medium for fixation.

Examples of urea bond formation group include isocyanate group, and the like. When the urea bond formation group of above-mentioned polyester resin containing urea bond formation group (RMPE) is an isocyanate group, isocyanate group-containing polyester prepolymer (A) is especially preferable as an polyester resin (RMPE).

The isocyanate group-containing polyester prepolymer (A) is not particularly limited and may be selected accordingly. Examples of isocyanate group-containing polyester prepolymer (A) include polycondensates of polyol (PO) and polycarboxylic acid (PC), provided that they are also reactants of active hydrogen group-containing polyester resin and polyisocyanate (PIC).

The polyol (PO) is not particularly limited and may be selected accordingly. Examples of polyol (PO) include diol (DIO), polyol having 3 or more valence, a mixture of diol and polyol having 3 or more valence (TO), and the like. These can be used alone or in combination. Of these, diol (DIO) alone, a mixture of diol (DIO) and a small amount of polyol having 3 or more valence (TO), or the like are preferable.

Examples of diol (DIO) include alkylene glycol, alkylene ether glycol, alicyclic diol, alkylene oxide adducts of alicyclic diol, bisphenols, alkylene oxide adducts of bisphenols, and the like.

The alkylene glycols of 2 to 12 carbon numbers are preferable and examples include ethylene glycol, 1,2-propylene glycol, 1,3-propylene glycol, 1,4-butanediol, and 1,6-hexanediol; alkylene ether glycols include diethylene glycol, triethylene glycol, dipropylene glycol, polyethylene glycol, polypropylene glycol, and polytetramethylene ether glycol; alicyclic diols such as 1,4-cyclohexane dimethanol and hydrogenated bisphenol A; alkylene oxide adducts of above-noted alicyclic diol such as ethylene oxide, propylene oxide, and butylene oxide; bisphenols such as bispheonol A, bisphenol F, and bisphenol S; and alkylene oxide adducts of the above-noted bisphenols such as ethylene oxide, propylene oxide, and butylene oxide.

Among them, alkylene glycol having carbon number 2 to 12 and alkylene oxide adducts of bisphenols are preferable, and alkylene oxide adducts of bisphenols and a combination of alkylene oxide adducts of bisphenols and alkylene glycol having carbon number 2 to 12 are particularly preferable.

The polyol having 3 or more valence (TO) is preferably having valency of 3 to 8 and examples thereof are polyaliphatic alcohol having 3 or more valence, polyphenols having 3 or more valence, alkylene oxide adducts of polyphenols having 3 or more valence, and the like.

Examples of polyol having 3 or more valence (TO) include polyaliphatic alcohol having 3 or more valence such as glycerine, trimethylol ethane, trimethylol propane, pentaerythritol, sorbitol, and the like. Examples of polyphenols having 3 or more valence include trisphenol PA, phenol novolac, cresol novolac, and like. The alkylene oxide adducts of above-mentioned polyphenols having 3 or more valence include ethylene oxide, propylene oxide, butylene oxide, and the like.

The mixing mass ratio, DIO:TO, of diol (DIO) and polyol having 3 or more valence (TO) is preferably 100:0.01 to 100:10 and more preferably 100:0.01 to 100:1.

Polycarboxilic acid (PC) is not particularly limited and may be selected accordingly. Examples of polycarboxilic acid include dicarboxilic acid (DIC), polycarboxilic acid having 3 or more valence (TC), a combination of dicarboxylic acid (DIC) and polycarboxilic acid having 3 or more valence, and the like.

These may be used alone or in combination. Of these, dicarboxylic acid (DIC) alone, or a combination of DIC and a small amount of polycarboxylic acid having 3 or more valence (TC) are preferable.

Examples of dicarboxylic acid include alkylene dicarboxylic acid, alkenylene dicarboxylic acid, aromatic dicarboxylic acid, and the like.

Examples of alkylene dicarboxylic acid include succinic acid, adipic acid, sebacic acid, and the like. Alkenylene dicarboxylic acid is preferably with carbon number 4 to 20 and examples thereof include maleic acid, fumar acid, and the like. Aromatic dicarboxylic acid is preferably with carbon number 8 to 20 and examples thereof include phthalic acid, isophthalic acid, terephthalic acid, naphthalendicarboxylic acid, and the like.

Of these, alkenylene dicarboxylic acid with carbon number 4 to 20 and aromatic dicarboxylic acid with carbon number 8 to 20 are preferable.

The valency number of polycarboxylic acid (TO) with 3 or more valence is preferably 3 to 8 and examples thereof include aromatic polycarboxylic acid, and the like.

Aromatic polycarboxylic acid is preferably with carbon number 9 to 20 and examples thereof include trimellitic acid, pyromellitic acid, and the like.

The polycarboxylic acid (PC) may be an acid anhydride or a lower alkyl ester selected from dicarboxylic acid (DIC), polycarboxylic acid having 3 or more valence and a combination of dicarboxylic acid (DIC) and polycarboxylic acid having 3 or more valence. Examples of lower alkyl ester include methyl ester, ethyl ester, isopropyl ester, and the like.

The mixing mass ratio, DIC:TC, of dicarboxylic acid (DIC) and polycarboxylic acid having 3 or more valence (TC) is not particularly limited and may be selected accordingly, and it is preferably 100:0.01 to 100:10 and more preferably 100:0.01 to 100:1.

A mixing ratio of polyol (PO) and polycarboxylic acid (PC) at the time of polycondensation reaction is not particularly limited and may be selected accordingly. For example, the equivalent ratio, [OH]/[COOH], of hydroxyl group [OH] of polyol (PO) and carboxyl group [COOH] of polycarboxilic acid (PC) in general is preferably 2/1 to 1/1 and more preferably 1.5/1 to 1/1 and most preferably 1.3/1 to 1.02/1.

The content of polyol (PO) in the isocyanate group-containing polyester prepolymer (A) is not particularly limited and may be adjusted accordingly, for example, it is preferably 0.5% by mass to 40% by mass, more preferably 1% by mass to 30% by mass and most preferably 2% by mass to 20% by mass.

If the content is less than 0.5% by mass, hot off-set resistance may be deteriorated, making it difficult to pursue anti-heat preservability and fixing property at low temperature at the same time. If the content is more than 40% by mass, fixing property at low temperature may be deteriorated.

The polyisocyanate (PIC) is not particularly limited and may be selected accordingly. Examples of polyisocyanate (PIC) include aliphatic polyisocyanate, alicyclic polyisocyanate, aromatic diisocyanate, aromatic aliphatic diisocyanate, isocyanurates, blocked-out ones thereof with phenol derivatives, oxime, capro lactam, and the like.

Examples of aliphatic polyisocyanate include tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, torimethylhexane diisocyanate, tetramethyhexane diisocyanate, and the like. Examples of alicyclic polyisocyanate include isophorone diisocyanate, cyclohexylmethane diisocyanate, and the like. Examples of aromatic diisocyanate include trilene diisocyanate, diphenylmethane diisocyanate, 1,5-naphtylene diisocyanate, diphenylene-4,4'-diisocyanate, 4,4'-diisocyanato-3,3'-dimethyldiphenyl, 3-methyldiphenylmethane-4,4'-diisocyanate, diphenylether-4,4'-diisocyanate, and the like. Examples of aromatic aliphatic diisocyanate include $\alpha,\alpha,\alpha',\alpha'$-tetramethylxylylene diisocyanate, and the like. Examples of isocyanurates include tris-isocyanatoalkyl-isocyanurate, toriisocyanatocycloalkyl-isocyanurate, and the like.

These may be used alone or in combination.

Generally, the equivalent mixing ratio, [NCO]/[OH], of isocyanate group [NCO] of polyisocyanate (PIC) to hydrogen group [OH] of active hydrogen group-containing polyester resin such as hydrogen group-containing polyester resin at the time of reaction, is preferably 5/1 to 1/1, more preferably 4/1 to 1.2/1 and most preferably 3/1 to 1.5/1.

If the value of isocyanate group [NCO] is more than 5, fixing property at low temperature may be deteriorated, and if it is less than 1, off-set resistance may be deteriorated.

The content of polyisocyanate (PIC) in the isocyanate group-containing polyester prepolymer (A) is not particularly limited and may be adjusted accordingly. It is preferably 0.5% by mass to 40% by mass, more preferably 1% by mass to 30% by mass and most preferably 2% by mass to 20% by mass.

If the content is less than 0.5% by mass, hot off-set resistance may be deteriorated, making it difficult to pursue anti-heat preservability and fixing property at low temperature simultaneously and if it is more than 40% by mass, fixing property at low temperature may be deteriorated.

The average quantity of isocyanate group contained within one molecule of the isocyanate group-containing polyester prepolymer (A) is preferably 1 or more, more preferably 1.2 to 5 and most preferably 1.5 to 4.

If the average quantity of isocyanate group is less than 1, molecular mass of polyester resin (RMPE) modified with urea bond formation group becomes low and hot off-set resistance may be deteriorated.

The average molecular mass (Mw) of the polymer reactive with active hydrogen group-containing compound, in terms of molecular mass distribution by Gelpermiation chromathography (GPC) of tetrahydrofuran (THF) soluble element, is preferably 1,000 to 30,000 and more preferably 1,500 to 15,000. The average molecular mass (Mw) is less than 1,000, anti-heat preservability may be deteriorated and if it is more than 30,000, fixing property at low temperature may be deteriorated.

The measurement of molecular mass distribution by Gelpermiation chromathography (GPC), for example, may be performed as follow.

First, the column inside the heat chamber of 40° C. is stabilized. At this temperature, tetrahydrofuran (THF) as a column solvent is drained at a current speed of 1 ml/minute and 50 μl to 200 μl of tetrahydrofuran sample fluid of the resin whereof a sample density is adjusted to 0.05% by mass to 0.6% by mass, is poured and measured. In the measurement of molecular mass of the sample, a molecular mass distribution of the sample is calculated from the relationship between log values of the analytical curve made from several monodisperse polystyrene standard samples and counted numbers. The standard polystyrene sample for making analytical curves is preferably the one with a molecular mass of $6\times10^2$, $2.1\times10^2$, $4\times10^2$, $1.75\times10^4$, $1.1\times10^5$, $3.9\times10^5$, $8.6\times10^5$, $2\times10^6$ and $48\times10^6$ by Pressure Chemical Co. or Tosoh Corporation and at least using approximately 10 pieces of the standard polystyrene sample is preferable. A flexibility (RI) detector may be used for above-mentioned detector.

--Binding Resin--

The binding resin is not particularly limited and may be selected accordingly. Examples thereof are polyester resin, and the like and unmodified polyester resin, that is a polyester resin not being modified, is especially preferable.

Containing unmodified polyester resin in a toner can improve fixing property at low temperature and glossiness.

Examples of unmodified polyester resin include the one similar to urea bond formation group-containing polyester resin such as polycondensation of polyol (PO) and polycarboxylic acid (PC), and the like. The unmodified polyester resin of which a part is compatible with the urea bond formation group-containing polyester resin (RMPE), that is, having similar structures that are compatible to each other, is preferable in terms of fixing property at low temperature and hot off-set resistance.

The average molecular mass (Mw) of unmodified polyester resin, in terms of the molecular mass distribution by GPC (Gelpermiation chromathography) of tetrahydrofuran (THF) soluble element, is preferably 1,000 to 30,000 and more preferably 1,500 to 15,000. The content of the element of which the average molecular mass (Mw) is less than 1,000, should be 8% by mass to 28% by mass in order to prevent deterioration of anti-heat preservability. If the average molecular mass (Mw) is more than 30,000, fixing property at low temperature may be deteriorated.

The glass transition temperature of the unmodified polyester resin is generally 30° C. to 70° C., preferably 35° C. to 70° C., more preferably 35° C. to 50° C. and most preferably 35° C. to 45° C. If the glass transition temperature is less than 30° C., anti-heat preservability of the toner may be deteriorated and if it is more than 70° C., fixing property at low temperature may be insufficient.

The hydroxyl value of unmodified polyester resin is preferably 5 mgKOH/g or more, more preferably 10 mgKOH/g to 120 mgKOH/g and most preferably 20 mgKOH/g to 80 mgKOH/g. If the hydroxyl value is less than 5 mgKOH/g, it is difficult to pursue anti-heat preservability and fixing property at low temperature simultaneously.

The acid value of unmodified polyester resin is preferably 1.0 mgKOH/g to 50.0 mgKOH/g, more preferably 1.0 mgKOH/g to 45.0 mgKOH/g and most preferably 15.0 mgKOH/g to 45.0 mgKOH/g. In general, a toner tend to become electrically negative by having acid values.

When unmodified polyester resin is contained in a toner, the mixing mass ratio, RMPE/PE, of urea bond formation group-containing polyester resin (RMPE) to unmodified polyester resin (PE) is preferably 5/95 to 25/75 and more preferably 10/90 to 25/75.

If the mixing mass ratio of unmodified polyester resin is more than 95, hot off-set resistance may be deteriorated, making it difficult to pursue anti-heat preservability and fixing property at low temperature simultaneously, and if it is less than 25, glossiness may be deteriorated.

The content of unmodified polyester resin in the binder resin, for example, is preferably 50% by mass to 100% by mass, more preferably 70% by mass to 95% by mass and most preferably 80% by mass to 90% by mass. If the content is less than 50% by mass, fixing property at low temperature or glossiness of the image may be deteriorated.

-Other Elements-

Other elements are not particularly limited and may be selected accordingly. Examples thereof include colorants, releasing agents, charge controlling agents, inorganic particles, flowability improvers, cleaning ability improvers, magnetic materials, metal soaps, and the like.

The colorants are not particularly limited and may be selected from known dyes and pigments accordingly. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and the like.

These may be used alone or in combination.

The content of the colorant in the toner is not particularly limited and may be adjusted accordingly and it is preferably 1% by mass to 15% by mass and more preferably 3% by mass to 10% by mass.

It the content is less than 1% by mass, tinctorial power of the colorant is degraded, and if the content is more than 15% by mass, a dispersion failure of pigments in the toner may occur, resulting in degradation of tinctorial power or electric properties of the toner.

The colorant may be used as a master batch being combined with a resin. Such resin is not particularly limited and may be selected accordingly. Examples thereof include polymers of styrene or substituted styrenes, styrene copolymers, polymethyl methacrylates, polybuthyl methacrylates, polyvinyl chlorides, polyvinyl acetates, polyethylenes, polypropylenes, polyesters, epoxy resins, epoxy polyol resins, polyurethanes, polyamides, polyvinyl butyral, polyacrylic acid resin, rosin, modified rosin, terpene resins, aliphatic or alicyclic hydrocarbon resins, aromatic petroleum resins, chlorinated paraffin, paraffin, and the like. These may be used alone or in combination.

Examples of polymers of styrene or substituted styrenes include polyester resin, polystyrene, poly-p-chlorostyrene, polyvinyl toluene, and the like. Examples of styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, and the like.

The master batch can be obtained by mixing and kneading a resin for master batch and the colorant with high shear force. To improve interaction between colorant and resin, an organic solvent may be used. In addition, the "flushing process" in which a wet cake containing colorant can be applied directly, is preferable because it requires no drying. In the flushing process, a water-based paste containing colorant and water is mixed and kneaded with the resin and an organic solvent so that the colorant moves towards the resin, and that water and the organic solvent are removed. The materials are preferably mixed and kneaded using a triple roll mill and other high-shear dispersing devices.

The releasing agent is not particularly limited and may be selected from known agents accordingly and examples include waxes, and the like.

Examples of wax include carbonyl group-containing wax, polyolefin wax, long-chain hydrocarbon, and the like. These may be used alone or in combination. Of these examples, carbonyl group-containing wax is preferable.

Examples of carbonyl group-containing wax include polyalkanoic acid ester, polyalkanol ester, polyalkanoic acid amide, polyalkyl amide, dialkyl ketone, and the like. Examples of polyalkanoic ester include carnauba wax, montan wax, trimethylolpropane tribehenate, pentaerythritol tetrabehenate, pentaerythritol diacetate dibehenate, glycerin tribehenate, 1,18-octadecan diol distearate, and the like. Examples of polyalkanol ester include trimellitic tristearate, distearyl maleate, and the like. Examples of polyalkanoic acid amide include behenyl amide and the like. Examples of polyalkyl amide include trimellitic acid tristearyl amide, and the like. Examples of dialkyl ketone include distearyl ketone, and the like. Of these carbonyl group-containing waxes, the polyalkanoic acid ester is particularly preferable.

Examples of polyolefin wax include polyethylene wax, polypropylene wax, and the like.

Examples of long-chain hydrocarbon include paraffin wax, Sasol Wax, and the like.

A melting point of the releasing agent is not particularly limited and may be selected accordingly. It is preferably 40° C. to 160° C., more preferably 50° C. to 120° C., and most preferably 60° C. to 90° C.

When the melting point is less than 40° C., the wax may adversely affect anti-heat preservability. When the melting point is more than 160° C., it is liable to cause cold offset at the time of fixing at low temperature.

A melt viscosity of the releasing agent is preferably 5 cps to 1,000 cps, and more preferably 10 cps to 100 cps by a measurement at a temperature of 20° C. higher than the melting point of the wax.

If the melt viscosity is less than 5 cps, releasing ability may be deteriorated. If the melt viscosity is more than 1,000 cps, on the other hand, it may not improve offset resistance, and fixing property at low temperature.

The content of releasing agent in the toner is not particularly limited and may be adjusted accordingly and it is preferably 0% by mass to 40% by mass and more preferably 3% by mass to 30% by mass.

If the content is more than 40% by mass, flowability of the toner may be deteriorated.

The charge controlling agent is not particularly limited, and may be selected from known agents accordingly. The charge controlling agent is preferably made of a material with color close to transparent and/or white because colored materials may change color tone.

Examples of charge controlling agent include triphenylmethane dye, molybdic acid chelate pigment, rhodamine dye, alkoxy amine, quaternary ammonium salt such as fluoride-modified quaternary ammonium salt, alkylamide, phosphoric simple substance or compound thereof, tungsten simple substance or compound thereof, fluoride activator, salicylic acid metallic salt, salicylic acid derivative metallic salt, and the like. These may be used alone or in combination.

The charge controlling agent may be selected from the commercially available products. Specific examples thereof include Bontron P-51 of a quaternary ammonium salt, Bontron E-82 of an oxynaphthoic acid metal complex, Bontron E-84 of a salicylic acid metal complrex and Bontron E-89 of a phenol condensate by Orient Chemical Industries, Ltd.; TP-302 and TP-415 of a quaternary ammonium salt molybdenum metal complex by Hodogaya Chemical Co.; Copy Charge PSY VP2038 of a quaternary ammonium salt, Copy Blue PR of a triphenylmethane derivative and Copy Charge NEG VP2036 and Copy Charge NX VP434 of a quaternary ammonium salt by Hoechst Ltd.; LRA-901, and LR-147 of a boron metal complex by Japan Carlit Co., Ltd.; quinacridone, azo pigment, and other high-molecular mass compounds having functional group of sulfonic acid, carboxyl, quaternary ammonium salt, or the like.

The charge controlling agent may be dissolved and/or dispersed in the toner material after kneading with the master batch. The charge controlling agent may also be added directly at the time of dissolving and dispersing in the organic solvent together with the toner material. In addition, the charge controlling agent may be added onto the surface of the toner particles after toner particle production.

The content of the charge controlling agent depends on the type of binder resin, presence or absence of external additives, and the dispersion process selected to use and there is no defined prescription. However, the content of charge controlling agent is preferably 0.1 part by mass to 10 parts by mass and more preferably 0.2 part by mass to 5 part by mass relative to 100 parts by mass of the binder resin, for example. When the content is less than 0.1 parts by mass, charge may not be appropriately controlled. If the content is more than 10 parts by mass, charge ability of the toner becomes excessively large, which lessens the effect of charge controlling agent itself and increases electrostatic attraction force with a developing roller, leading to developer flowability or image density degradation.

-Resin Fine Particles-

The resin fine particles are not particularly limited as long as they are capable of forming an aqueous dispersion in an aqueous medium, and may be selected from known resins accordingly. The resin fine particles may be formed of thermoplastic resin or thermoset resin. Examples of resin fine particles include vinyl resin, polyurethane resin, epoxy resin, polyester resin, polyamide resin, polyimide resin, silicone resin, phenol resin, melamine resin, urea resin, anilline resin, ionomer resin, polycarbonate resin, and the like. Of these, vinyl resin is the most preferable.

These may be used alone or in combination. Among these examples, the resin fine particles formed of at least one selected from the vinyl resin, polyurethane resin, epoxy resin, and polyester resin by which an aqueous dispersion of fine spherical-shaped resin fine particles is easily obtained, are preferable.

The vinyl resin is a polymer in which vinyl monomer is mono- or co-polymerized. Examples of vinyl resin include styrene-(meth)acrylic acid ester resin, styrene-butadiene copolymer, (meth)acrylic acid-acrylic acid ester copolymer, sthrene-acrylonitrile copolymer, styrene-maleic anhydride copolymer, styrene-(meth)acrylic acid copolymer, and the like.

Moreover, the resin fine particles may be formed of copolymer containing a monomer having at least two or more unsaturated groups. The monomer having at least two or more unsaturated groups is not particularly limited and may be selected accordingly. Examples of such monomer include sodium salt of sulfuric acid ester of methacrylic acid ethylene oxide adduct (Eleminol RS-30 by Sanyo Chemical Industries Co.), divinylbenzene, hexane-1,6-diol acrylate, and the like.

The resin fine particles are formed by polymerization performed by the method appropriately selected from known methods. The resin fine particles are preferably obtained in a form of aqueous dispersion of the resin fine particles. Examples of preparation method of such aqueous dispersion include (1) a direct preparation method of aqueous dispersion of the resin fine particles in which, in the case of the vinyl resin, a vinyl monomer as a raw material is polymerized by suspension-polymerization method, emulsification-polymerization method, seed polymerization method or dispersion-polymerization method; (2) a preparation method of aqueous dispersion of the resin fine particles in which, in the case of the polyaddition and/or condensation resin such as polyester resin, polyurethane resin, or epoxy resin, a precursor (monomer, oligomer or the like) or solvent solution thereof is dispersed in an aqueous medium in the presence of a dispersing agent, and heated or added with a curing agent so as to be cured, thereby obtaining the aqueous dispersion of the resin fine particles; (3) a preparation method of aqueous dispersion of the resin fine particles in which, in the case of the polyaddition and/or condensation resin such as polyester resin, polyurethane resin, or epoxy resin, an arbitrary selected emulsifier is dissolved in a precursor (monomer, oligomer or the like) or solvent solution thereof (preferably being liquid, or being liquidized by heating), and then water is added so as to induce phase inversion emulsification, thereby obtaining the aqueous dispersion of the resin fine particles; (4) a preparation method of aqueous dispersion of the resin fine particles, in which a resin, previously prepared by polymerization method which may be any of addition polymerization, ring-opening polymerization, polyaddition, addition condensation, or condensation polymerization, is pulverized by means of a pulverizing mill such as mechanical rotation-type, jet-type or the like, and classified to obtain resin fine particles, and then the resin fine particles are dispersed in an aqueous medium in the presence of an arbitrary selected dispersing agent, thereby obtaining the aqueous dispersion of the resin fine particles; (5) a preparation method of aqueous dispersion of the resin fine particles, in which a resin, previously prepared by a polymerization method which may be any of addition polymerization, ring-opening polymerization, polyaddition, addition condensation or condensation polymerization, is dissolved in a solvent, the obtained resin solution is sprayed in the form of a mist to thereby obtain resin fine particles, and then the obtained resin fine particles are dispersed in an aqueous medium in the presence of an arbitrary selected dispersing agent, thereby obtaining the aqueous dispersion of the resin fine particles; (6) a preparation method of aqueous dispersion of the resin fine particles, in which a resin, previously prepared by a polymerization method, which may be any of addition polymerization, ring-opening polymerization, polyaddition, addition condensation or condensation polymerization, is dissolved in a solvent, the obtained resin solution is subjected to precipitation by adding a poor solvent or cooling after heating and dissolving, the solvent is sequentially removed to thereby obtain resin fine particles, and then the obtained resin fine particles are dispersed in an aqueous medium in the presence of an arbitrary selected dispersing agent, thereby obtaining the aqueous dispersion of the resin fine particles; (7) a preparation method of aqueous dispersion of the resin fine particles, in which a resin, previously prepared by a polymerization method, which may be any of addition polymerization, ring-opening polymerization, polyaddition, addition condensation or condensation polymerization, is dissolved in a solvent to thereby obtain a resin solution, the resin solution is dispersed in an aqueous medium in the presence of an arbitrary selected dispersing agent, and then the solvent is removed by heating or reduced pressure to thereby obtain the aqueous dispersion of the resin fine particles; (8) a preparation method of aqueous dispersion of the resin fine particles, in which a resin, previously prepared by a polymerization method, which is any of addition polymerization, ring-opening polymerization, polyaddition, addition condensation or condensation polymerization, is dissolved in a solvent to thereby obtain a resin solution, an arbitrary selected emulsifier is dissolved in the resin solution, and then water is added to the resin solution so as to induce phase inversion emulsification, thereby obtaining the aqueous dispersion of the resin fine particles.

Examples of toner include a toner which is produced by known methods such as suspension-polymerization method, emulsion-aggregation method, emulsion-dispersion method, and the like. The toner is preferably produced by dissolving an active hydrogen group-containing compound and a polymer reactive with the compound in an organic solvent to prepare a toner solution, dispersing the toner solution in an aqueous medium so as to form a dispersion, allowing the active hydrogen group-containing compound and the polymer reactive with the compound to react so as to form an adhesive base material in the form of particles, and removing the organic solvent.

-Toner Solution-

The toner solution is prepared by dissolving the toner material in an organic solvent.

--Organic Solvent--

The organic solvent is not particularly limited and may be selected accordingly, provided that the organic solvent allows the toner material to be dissolved and/or dispersed therein. It is preferable that the organic solvent is a volatile organic solvent having a boiling point of less than 150° C. in terms of easy removal from the solution or dispersion. Suitable examples thereof are toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these solvents, toluene, xylene, benzene, methylene chloride, 1,2-dichloroethane, chloroform, carbon tetrachloride are preferable and furthermore, ethyl acetate is more preferable. These solvents may be used alone or in combination.

The used amount of organic solvent is not limited and may be adjusted accordingly. It is preferably 40 parts by mass to 300 parts by mass, more preferably 60 parts by mass to 140 parts by mass and most preferably 80 parts by mass to 120 parts by mass with respect to 100 parts by mass of the toner material.

-Dispersion-

The dispersion is prepared by dispersing toner solution in an aqueous medium.

When the toner solution is dispersed in an aqueous medium, a dispersing element (oilspot) is formed in the aqueous medium.

--Aqueous Medium--

The aqueous medium is not particularly limited and may be selected from known mediums such as water, water-miscible solvent, and a combination thereof. Of these, water is particularly preferable.

The water-miscible solvent is not particularly limited, provided that it is miscible with water, and examples thereof include alcohol, dimethylformamide, tetrahydrofuran, Cellsolves, lower ketones, and the like.

Examples of alcohol include methanol, isopropanol, ethylene grycol, and the like. Examples of lower ketones include acetone, methyl ethyl ketone, and the like.

These may be used alone or in combination.

It is preferable to disperse the toner solution in the aqueous medium while stirring.

The method for dispersion is not particularly limited and may be selected from known dispersers such as low-speed-shear disperser, high-speed-shear disperser, friction disperser, high-pressure-jet disperser, supersonic disperser, and the like. Of these, high-speed-shear disperser is preferable, because it is capable of controlling particle diameter of the dispersing element (oilspot) to be within a range of 2 μm to 20 μm.

When the high-speed shear disperser is used, conditions like rotating speed, dispersion time, dispersion temperature, and the like are not particularly limited and may be adjusted accordingly. However, rotating frequency is preferably 1,000 rpm to 30,000 rpm and more preferably 5,000 rpm to 20,000 rpm. The dispersion time is preferably 0.1 minute to 5 minutes for batch method. The dispersion temperature is preferably 0° C. to 150° C. and more preferably 40° C. to 98° C. Generally speaking, the dispersion is more easily carried out at a high dispersing temperature.

An exemplary manufacturing process of toner in which toner is manufactured by producing adhesive base material in a form of particles is described below.

In the process in which toner is manufactured by producing adhesive base material in a form of particles, a preparation of an aqueous medium phase, a preparation of toner solution, a preparation of dispersion, an addition of aqueous medium and other processes such as synthesis of active hydrogen group-containing compound and reactive prepolymer thereof or synthesis of active hydrogen group-containing compound, and the like, for example.

The preparation of aqueous medium phase may be, for example, done by dispersing resin fine particles in the aqueous medium. The amount of resin fine particles added to the aqueous medium is not limited and may be adjusted accordingly and it is preferably 0.5% by mass to 10% by mass, for example.

The preparation of toner solution may be done by dissolving and/or dispersing toner materials such as active hydrogen group-containing compound, reactive prepolymer thereof, colorant, releasing agent, charge controlling agent and unmodified polyester resin, and the like in the organic solvent.

These toner materials except active hydrogen group-containing compound and reactive prepolymer thereof may be added and blended in the aqueous medium when resin fine particles are being dispersed in the aqueous medium in the aqueous medium phase preparation, or they may be added into the aqueous medium phase together with toner solution when toner solution is being added into the aqueous medium phase.

The preparation of dispersion may be carried out by emulsifying and/or dispersing the previously prepared toner solution in the previously prepared aqueous medium phase. At the time of emulsifying and/or dispersing, the active hydrogen group-containing compound and the polymer reactive with the compound are subjected to elongation and/or crosslinking reaction, thereby forming the adhesive base material.

The adhesive base material (e.g. the aforementioned urea-modified polyester) is formed, for example, by (1) emulsifying and/or dispersing the toner solution containing the polymer reactive with the compound (e.g. isocyanate group-containing polyester prepolymer (A)) in the aqueous medium phase together with the active hydrogen group-containing compound (e.g. amines (B)) so as to form a dispersion, and then the active hydrogen group-containing compound and the polymer reactive with the compound are subjected to elongation and/or crosslinking reaction in the aqueous medium phase; (2) emulsifying and/or dispersing toner solution in the aqueous medium previously added with the active hydrogen group-containing compound to form a dispersion, and then the active hydrogen group-containing compound and the polymer reactive with the compound are subjected to elongation and/or crosslinking reaction in the aqueous medium phase; (3) after adding and mixing toner solution in the aqueous medium, the active hydrogen group-containing compound is sequentially added thereto so as to form a dispersion, and then the active hydrogen group-containing compound and the polymer reactive with the compound are subjected to elongation and/or crosslinking reaction at an interface of dispersed particles in the aqueous medium phase.

In the process (3), it should be noted that modified polyester resin is preferentially formed on the surface of manufacturing toner particles, thus it is possible to generate concentration gradient in the toner particles.

Condition of reaction for forming adhesive base material by emulsifying and/or dispersing is not particularly limited and may be adjusted accordingly with a combination of active hydrogen group-containing compound and the polymer reactive with the compound. A suitable reaction time is preferably from 10 minutes to 40 hours and more preferably from 2 hours to 24 hours. A suitable reaction temperature is preferably from 0° C. to 150° C. and more preferably from 40° C. to 98° C.

A suitable formation of the dispersion containing the active hydrogen group-containing compound and the polymer reactive with the compound (e.g. the isocyanate group-containing polyester prepolymer (A)) in the aqueous medium phase is, for example, a process in which the toner solution, produced from toner materials such as the polymer reactive with the active hydrogen group-containing compound (e.g. the isocyanate group-containing polyester prepolymer (A)), colorant, wax, charge controlling agent, unmodified polyester, and the like that are dissolved and/or dispersed in the organic solvent, is added in the aqueous medium phase and dispersed by shear force. The detail of the dispersion process is as described above.

When preparing dispersion, a dispersant is preferably used in order to stabilize the dispersing element (oil droplets formed from toner solution) and sharpen the particle size distribution while obtaining a predetermined shape of the dispersing element.

The dispersant is not particularly limited and may be selected accordingly. Examples of dispersant include surfactant, water-insoluble inorganic dispersant, polymeric protective colloid, and the like. These may be used alone or in combination. Of these examples, surfactant is most preferable.

Examples of surfactant include anionic surfactant, cationic surfactant, nonionic surfactant, ampholytic surfactant, and the like.

Examples of anionic surfactant include alkylbenzene sulfonic acid salts, α-olefin sulfonic acid salts, phosphoric acid ester, and the like. Among these, an anionic surfactant having fluoroalkyl group is preferable. Examples of anionic surfactant having fluoroalkyl group include fluoroalkyl carboxylic acid having 2 to 10 carbon atoms or metal salt thereof, disodium perfluorooctanesulfonylglutamate, sodium-3-{omega-fluoroalkyl (Carbon number 6 to 11)oxy}-1-alkyl(Carbon number 3 to 4) sulfonate, sodium-3-{omega-fluoroalkanoyl (Carbon number 6 to 8)-N-ethylamino}-1-propanesulfonate, fluoroalkyl(Carbon number 11 to 20) carboxylic acid or metal salt thereof, perfluoroalkyl(Carbon number 7 to 13) carboxylic acid or metal salt thereof, perfluoroalkyl(Carbon number 4 to 12) sulfonic acid or metal salt thereof, perfluorooctanesulfonic acid diethanol amide, N-propyl-N-(2-hydroxyethyl) perfluorooctanesulfone amide, perfluoroalkyl (Carbon number 6 to 10) sulfoneamidepropyltrimethylammonium salt, perfluoroalkyl (Carbon number 6 to 10)-N-ethylsulfonyl glycin salt, monoperfluoroalkyl(Carbon number 6 to 16)ethylphosphate ester, and the like. Examples of commercially available surfactant containing fluoroalkyl group are: Surflon S-111, S-112 and S-113 by Asahi Glass Co.; Frorard FC-93, FC-95, FC-98 and FC-129 by Sumitomo 3M Ltd.; Unidyne DS-101 and DS-102 by Daikin Industries, Ltd.; Megafac F-110, F-120, F-113, F-191, F-812 and F-833 by Dainippon Ink and Chemicals, Inc.; ECTOP EF-102, 103, 104, 105, 112, 123A, 123B, 306A, 501, 201 and 204 by Tohchem Products Co.; Futargent F-100 and F150 by Neos Co.

Examples of cationic surfactant include amine salt surfactant, quaternary ammonium salt surfactant, and the like. Examples of amine salt surfactant include alkyl amine salt, aminoalcohol fatty acid derivative, polyamine fatty acid derivative, imidazoline, and the like. Examples of quaternary ammonium salt surfactant include alkyltrimethyl ammonium salt, dialkyldimethyl ammonium salt, alkyldimethyl benzyl ammonium salt, pyridinium salt, alkyl isoquinolinium salt, benzethonium chloride, and the like. Among these, preferable examples are primary, secondary or tertiary aliphatic amine acid having fluoroalkyl group, aliphatic quaternary ammonium salt such as perfluoroalkyl (Carbon number 6 to 10)

sulfoneamidepropyltrimethylammonium salt, benzalkonium salt, benzetonium chloride, pyridinium salt, imidazolinium salt, and the like. Specific examples of commercially available product thereof are Surflon S-121 by Asahi Glass Co., Frorard FC-135 by Sumitomo 3M Ltd., Unidyne DS-202 by Daikin Industries, Ltd., Megafack F-150 and F-824 by Dainippon Ink and Chemicals, Inc., Ectop EF-132 by Tohchem Products Co., and Futargent F-300 by Neos Co.

Examples of nonionic surfactant include fatty acid amide derivative, polyhydric alcohol derivative, and the like.

Examples of ampholytic surfactant include alanine, dodecyldi(aminoethyl)glycin, di(octylaminoethyl)glycin, N-alkyl-N,N-dimethylammonium betaine, and the like.

Examples of water-insoluble inorganic dispersant include tricalcium phosphate, calcium carbonate, titanium oxide, colloidal silica, hydroxyl apatite, and the like.

Examples of polymeric protective colloid are acids, (meta) acrylic monomers having hydroxyl group, vinyl alcohol or esters thereof, esters of vinyl alcohol and compound having carboxyl group, amide compounds or methylol compounds thereof, chlorides, monopolymers or copolymers having nitrogen atom or heterocyclic rings thereof, polyoxyethylenes, celluloses, and the like.

Examples of acids include acrylic acid, methacrylic acid, α-cyanoacrylic acid, α-cyanomethacrylic acid, itaconic acid, crotonic acid, fumaric acid, maleic acid, maleic anhydride, and the like.

Examples of (meta) acrylic monomers having hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic ester, diethyleneglycol monomethacrylic ester, glycerin monoacrylic ester, glycerin monomethacrylic ester, N-methylol acrylamido, N-methylol methacrylamide, and the like. Examples of vinyl alcohol or ethers of vinyl alcohol include vinyl methyl ether, vinyl ethyl ether, vinyl propyl ether, and the like. Examples of ethers of vinyl alcohol and compound having carboxyl group include vinyl acetate, vinyl propionate, vinyl butyrate, and the like. Examples of amide compound or methylol compound thereof include acryl amide, methacryl amide, diacetone acrylic amide acid, or methylol thereof, and the like. Examples of chlorides include acrylic chloride, methacrylic chloride, and the like. Examples of monopolymers or copolymers having nitrogen atom or heterocyclic rings thereof include vinyl pyridine, vinyl pyrrolidone, vinyl imidazole, ethylene imine, and the like. Examples of polyoxyethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenyl ester, polyoxyethylene nonylphenyl ester, and the like. Examples of celluloses include methyl cellulose, hydroxyethyl cellulose, hydroxypropyl cellulose, and the like.

In the preparation of dispersion, a dispersing stabilizer may be employed as necessary. The dispersing stabilizer is, for example, acid-soluble or alkali-soluble compound such as calcium phosphate, and the like.

When dispersing stabilizer is employed, the dispersing stabilizer is dissolved by acid such as hydrochloric acid, and then washed with water or decomposed by enzyme, etc. to be removed from particles.

In the preparation of dispersion, a catalyst for the elongation and/or crosslinking reaction may be employed as necessary. The catalyst is, for example, dibutyltin laurate, dioctyltin laurate, and the like.

The organic solvent is removed from the obtained dispersion (emulsified slurry). The removal of organic solvent is carried out, for example, by the following methods: (1) the temperature of the dispersion is gradually increased, and the organic solvent in the oil droplets are completely evaporated and removed; (2) emulsified dispersion is sprayed in a dry atmosphere and the water-insoluble organic solvent is completely evaporated and removed from the oil droplets to form toner particles, while aqueous dispersant is evaporated and removed simultaneously.

Once organic solvent is removed, toner particles are formed. The toner particles are then preceded with washing, drying, and the like. And then toner particles may be classified as necessary. The classification is, for example, carried out by cyclone, decanter, or centrifugal separation thereby removing particles in the solution. Alternatively, the classification may be carried out after toner particles are obtained as powder by drying.

The obtained toner particles are subjected to mixing with particles such as colorant, wax, charge controlling agent, etc., and mechanical impact, thereby preventing particles such as wax falling off from the surface of the toner particles.

Examples of the method for imparting mechanical impact include a method in which an impact is imparted by rotating a blade at high speed, and a method in which an impact is imparted by introducing the mixed particles into a high-speed flow and accelerating the speed of the flow so as to make the particles to clash with each other or to make the composite particles to clash with an impact board. Examples of device employed for such method are angmill by Hosokawamicron Corp., modified I-type mill by Nippon Pneumatic Mfg. Co., Ltd. to decrease crushing air pressure, hybridization system by Nara Machinery Co., Ltd., krypton system by Kawasaki Heavy Industries, Ltd., automatic mortar, and the like.

The toner preferably has the following volume average particle diameter (Dv), a ratio (Dv/Dn) of volume average particle diameter (Dv) to number average particle diameter (Dn), average circularity, shape factor SF-1 and SF-2, and the like.

The volume average particle diameter (Dv) of the toner is preferably 3 μm to 8 μm, more preferably 4 μm to 7 μm and most preferably 5 μm to 6 μm. The volume average particle diameter is defined as the following formula: $Dv=[(\Sigma(nD^3)/\Sigma n)^{1/3}$, where n is number of particle and D is particle diameter.

When the volume average particle diameter is less than 3 μm, the toner of two-component developer is likely to fuse onto the carrier surfaces as a result of stirring in the developing unit for a long period and the charging capability of carrier may be deteriorated. On the other hand, one-component developer is likely to cause filming to the developing roller or fusion to the members such as blade for reducing toner layers thickness. If the volume average particle diameter is more than 8 μm, obtaining high-resolution, high-quality images becomes difficult, and the particle diameter of toner may fluctuate when toner inflow/outflow is implemented in the developer.

The ratio (Dv/Dn) of the volume average particle diameter (Dv) to the number average particle diameter (Dn) is preferably 1.25 or less, more preferably 1.00 to 1.20, and most preferably 1.10 to 1.20.

When the ratio is 1.25 or less, the toner is likely to have relatively sharp particle size distribution, thus improving the fixing properties. When the ratio is less than 1.00, the toner of two-component developer is likely to fuse onto the carrier surfaces due to stirring in a developing unit for a long period, thereby degrading charging capability of the carrier or cleaning properties, and one-component developer is likely to cause filming to the developing roller or fusion to the member such as blade for reducing toner layer thickness. When the ratio is more than 1.20, obtaining high-resolution, high-quality images becomes difficult, and the particle diameter of toner may fluctuate when toner inflow/outflow is implemented in the developer.

The volume average particle diameter and the ratio (Dv/Dn) are measured, for example, by means of the particle size analyzer, MultiSizer II by Beckmann Coulter Inc.

The average circularity can be obtained by subtracting the circumference of actual toner particle from the circumference of an equivalent circle having the same projected area as the shape of toner particle. The average circularity is preferably 0.900 to 0.98 and more preferably 0.940 to 0.98.

When the average circularity is less than 0.900, shape of the toner becomes irregular, being far from circle, and cannot obtain sufficient transfer properties or high quality images with no dust.

When the average circularity is more than 0.98, it is likely to cause image smears resulted from cleaning failures on the photoconductor or transfer belt in the image-forming system utilizing cleaning blades. Specifically, in the case of image formation having large image area such as photographic images, a residual toner resulted from forming untransferred images on the photoconductor due to paper feed failure or the like, is accumulated and causes background smear on the formed image, or pollutes charging rollers which contact-charge the photoconductor and inhibit charging rollers to exhibit original charging ability.

The average circularity is measured, for example, by the optical detection zone method in which a suspension containing toner is passed through an image-detection zone disposed on a plate, the particle images of the toner are optically detected by CCD camera, and the obtained particle images are analyzed. For example, the flow-type particle image analyzer FPIA-2100 by Sysmex Corp. may be employed for such method.

The shape factor SF-1 and SF-2 may be defined, for example, from the calculated values by Equations 1 and 2 stated below, after sampling 300 pieces of randomly-selected SEM-images of toner obtained by FE-SEM (S-4200) by Hitachi, Ltd. and investigating the image information by an image analysis apparatus, Luzex AP by Nireco Corporation through interface. The calculated values from Equation 1 and Equation 2 are defined as the shape factor SF-1 and SF-2. The values obtained by Luzex are preferable for SF-1 and SF-2, however, provided that similar result can be obtained; it is not limited to above FE-SEM or image analysis apparatuses.

$$SF\text{-}1=(L^2/A)\times(\pi/4)\times 100 \quad \text{Equation 1}$$

$$SF\text{-}2=(P^2/A)\times(1/4\pi)\times 100 \quad \text{Equation 2}$$

L represents absolute maximum length, A represents projective area and P represents maximum perimeter.

If it is a sphere, both SF-1 and SF-2 becomes 100, and as the value increases from 100, the spherical form becomes infinite form. And specifically, SF-1 represents the shape, such as ellipse or sphere, of the whole toner, whereas SF-2 represents the shape factor indicating the degree of roughness of the surface.

The coloration of the toner is not particularly limited and may be selected accordingly. For example, the coloration is at least one selected from black toner, cyan toner, magenta toner and yellow toner. Each color toner is obtained by appropriately selecting the colorant to be contained therein. It is preferably a color toner.

(Developer)

The developer of the present invention at least contains the toner of the present invention and further contains other appropriately selected components such as the aforementioned carrier. The developer can be either one-component developer or two-component developer. However, the two-component developer is preferable in terms of improved life span when the developer is used, for example, in a high-speed printer that corresponds to the improvement of recent information processing speed.

The one-component developer using the toner of the present invention exhibits less fluctuation in the toner particle diameter after toner inflow/outflow, and the toner filming to the developing roller or the fusion of toner onto the members such as blades for reducing toner layer thickness are absent, therefore providing excellent and stable developing property and images over long-term use (stirring) of the developing unit. The two-component developer using toner of the present invention exhibits less fluctuation in the toner particle diameter after toner inflow/outflow for prolonged periods, and the excellent and stable developing property can be obtained after stirring in a developing unit for prolonged periods.

The carrier is not particularly limited and may be selected accordingly. It is preferably the one having a core material and a resin layer coating the core material.

The core material is not particularly limited and may be selected from known materials. For example, 50 emu/g to 90 emu/g of manganese, strontium (Mn, Sr) materials, manganese, magnesium (Mn, Mg) materials, and the like are preferred. Highly magnetizable materials such as iron powder (100 emu/g or more), magnetite (75 emu/g to 120 emu/g), and the like are preferred in terms of ensuring appropriate image density. Weak magnetizable materials such as copper—zinc (Cu—Zn) materials (30 emu/g to 80 emu/g) are preferred in terms of reducing the impact on photoconductor where toner is forming a magnetic brush, therefore advantageous for improving image quality. These may be used alone or in combination.

The average particle diameter (volume average particle diameter ($D_{50}$)) of the core material is preferably 10 μm to 200 μm and more preferably 40 μm to 100 μm.

When the average particle diameter (volume average particle diameter ($D_{50}$)) is less than 10 μm, the amount of fine powder in the carrier particle size distribution increases whereas magnetization per particle decreases resulting in the carrier scattering. When the average particle diameter is more than 200 μm, the specific surface area decreases and causes carrier scattering. Therefore, for a full-color image having many solid parts, reproduction of the solid parts in particular may be insufficient.

The resin material is not particularly limited and may be selected from known resins accordingly. Examples of resin material include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymers of vinylidene fluoride and acryl monomer, copolymers of vinylidene fluoride and vinyl fluoride, fluoroterpolymer such as terpolymer of tetrafluoroethylene, vinylidene fluoride and non-fluoride monomer, silicone resin, and the like. These may be used alone or in combination.

Examples of amino resin include urea-formaldehyde resin, melamine resin, benzoguanamine resin, urea resin, polyamide resin, epoxy resin, and the like. Examples of polyvinyl resin include acryl resin, polymethylmetacrylate resin, polyacrylonitrile resin, polyvinyl acetate resin, polyvinyl alcohol resin, polyvinyl butyral resin, and the like. Examples of polystyrene resin include polystyrene resin, styrene acryl copolymer resin, and the like. Examples of halogenated olefin resin include polyvinyl chloride, and the like. Examples of polyester resin include polyethyleneterephtalate resin and polybutyleneterephtalate resin, and the like.

The resin layer may contain, for example, conductive powder, etc. as necessary. Examples of conductive powder include metal powder, carbon black, titanium oxide, tin oxide, zinc oxide, and the like. The average particle diameter of conductive powder is preferably 1 μm or less. When the average particle diameter is more than 1 μm, controlling electrical resistance may be difficult.

The resin layer may be formed by, for example, dissolving silicone resin, etc. in a solvent to prepare a coating solution, uniformly applying the coating solution to the surface of core material by known method, drying, and baking. Examples of application method include immersion, spray, and brushing, etc.

The solvent is not particularly limited and may be selected accordingly. Examples of solvent include toluene, xylene, methyethylketone, methylisobutylketone, cerusolbutylacetate, and the like.

The baking is not particularly limited and may be done by external heating or internal heating. Examples of baking method include the one using fixed electric furnace, flowing electric furnace, rotary electric furnace, burner or microwave.

The content of resin layer in the carrier is preferably 0.01% by mass to 5.0% by mass. When it is less than 0.01% by mass, the resin layer may not be formed uniformly on the surface of the core material. When it is more than 5.0% by mass, the resin layer may become excessively thick causing granulation between carriers, and the uniform carrier particles may not be obtained.

When developer is a two-component developer, the content of the carrier in the two-component developer is not particularly limited and may be selected accordingly. For example, the content is preferably 90% by mass to 98% by mass and more preferably 93% by mass to 97% by mass.

The mixing ratio of toner to carrier of the two-component developer is 1 part by mass to 10.0 parts by mass of toner relative to 100 parts by mass of carrier, in general.

The developer of the present invention contains the toner of the present invention and has excellent offset resistance and anti-heat preservability, therefore it is capable of forming excellent, clear and high-quality images constantly.

The developer of the present invention may be suitably used in forming images by various electrophotographic methods known such as magnetic one-component developing, non-magnetic one-component developing, two-component developing, and the like. In particular, the developer of the present invention may be suitably used in the toner container, process cartridge, image forming apparatus, and image forming method of the present invention as described below.

(Toner Container)

The toner container of the present invention is a container filled with the toner and/or the developer of the present invention.

The container is not particularly limited and may be selected from known containers. Preferable examples of the container include one having a toner container body and a cap.

The toner container body is not particularly limited in size, shape, structure or material and may be selected accordingly. The shape is preferably a cylinder. It is particularly preferable that a spiral ridge is formed on the inner surface and the contained toner is movable toward discharging end when rotated and the spiral part, whether partly or entirely, serves as bellows.

The material of the toner container body is not particularly limited and preferably being dimensionally accurate. For example, resins are preferable. Among resins, polyester resin, polyethylene resin, polypropylene resin, polystyrene resin, polyvinyl chloride resin, polyacrylic acid, polycarbonate resin, ABS resin, polyacetal resin, and the like are preferable.

The toner container of the present invention is easy to preserve and ship and is handy. It is suitably used by being detachably mounted on the process cartridge, image forming apparatus, and the like which are described later, for supplying toner.

(Process Cartridge)

The process cartridge of the present invention at least comprises a latent electrostatic image bearing member for bearing a latent electrostatic image and a developing unit for developing the latent electrostatic image on the latent electrostatic image bearing member using developer and further comprises charging unit, exposing unit, developing unit, transferring unit, cleaning unit, discharging unit and other units selected accordingly.

The developing unit at least contains a developer container for storing the toner and/or developer of the present invention and a developer carrier for carrying and transferring the toner and/or developer stored in the developer container and may further contain a layer thickness control member for controlling the thickness of carried toner layer.

The process cartridge of the present invention may be detachably mounted on a variety of electrophotographic apparatuses, facsimile and printers and is preferably detachably mounted on the electrophotographic apparatus of the present invention, which is described later.

The process cartridge comprises, for example as shown in FIG. 1, built-in photoconductor 101, charging unit 102, developing unit 104 and cleaning unit 107 and, where necessary, further comprises other members. In FIG. 1 also shown is the exposure unit 103 in which a light source capable of high resolution writing is used. The recording medium 105 and conveyer roller 108 are also shown.

The photoconductor 101 may be identical to the image forming apparatus described later.

The charging unit 102 can be any charging member.

The image forming apparatus of the invention may be constructed as a process cartridge unit containing latent electrostatic image bearing member, developing unit and cleaning unit, etc. placed onto the main body as detachable. Alternatively, a process cartridge unit containing photoconductors and at least one selected from charger, image exposing machine, developing unit, transfer or separation unit and cleaning unit may be constructed and placed onto the main body of image forming apparatus as a detachable single-unit and this may be done by employing guidance unit such as main body rails, etc.

(Image Forming Apparatus and Image Forming Method)

The image forming apparatus of the invention contains photoconductor, latent electrostatic image forming unit, developing unit, transferring unit, fixing unit and other units such as discharging unit, recycling unit and control unit as necessary.

The image forming method of the invention include latent electrostatic image forming, developing, transferring, fixing and other steps such as discharging, cleaning, recycling, controlling, etc. as necessary.

The image forming method of the invention may be favorably implemented by the image forming apparatus of the invention. The latent electrostatic image forming may be performed by the latent electrostatic image forming unit, the developing may be performed by the developing unit, the transferring may be performed by the transferring unit, and the fixing may be performed by the fixing unit. And other steps may be performed by other units respectively.

-Latent Electrostatic Image Forming and Latent Electrostatic Image Forming Unit- The latent electrostatic image forming is a step that forms a latent electrostatic image on the photoconductor.

Materials, shapes, structures or sizes, etc. of the photoconductor are not limited and may be selected accordingly and it is preferably drum-shaped. The materials thereof are, for example, inorganic photoconductors such as amorphous silicon, selenium; organic photoconductors such as polysilane, phthalopolymethine, and the like. Of these examples, amorphous silicon is preferred for its longer operating life.

For the amorphous silicon photoconductor, a photoconductor, (hereafter may be referred to as "a-Si series photoconductor") having a photo-conductive layer made of a-Si that is formed on the support by coating method such as vacuum deposition, sputtering, ion-plating, thermo-CVD, photo-CVD, plasma-CVD, and the like, while support is being heated at 50° C. to 400° C., may be used. Of these coating methods, plasma-CVD, whereby a-Si cumulo-layer is formed on the support by decomposition of the material gas by direct current, high-frequency wave or microwave glow discharge, is preferable. The latent electrostatic image may be formed, for example, by uniformly charging the surface of photoconductor, and irradiating it imagewise, and this may be performed by the latent electrostatic image forming unit.

The latent electrostatic image forming unit, for example, contains a charger which uniformly charges the surface of photoconductor, and an irradiator which exposes the surface of latent image bearing member imagewise.

Charging may be performed, for example, by applying a voltage to the surface of photoconductor using a charger.

The charger is not limited and may be selected accordingly. Examples of charger include known contact chargers equipped with conductive or semi-conductive roller, brush, film or rubber blade and non-contact chargers using corona discharges such as corotron or scorotron, etc.

The configuration of charging members may be of magnetic brush, fur brush or any other configurations other than of the roller, and may be selected according to the specification or configuration of the electrophotographic apparatus. In the apparatus where magnetic brush is used, the magnetic brush is constructed with various ferrite particles such as Zn—Cu ferrite that are used as charging members, nonmagnetic conductive sleeve supporting the charging member, and the magnet roll contained in the nonmagnetic conductive sleeve. When a brush is used, for example, fur is made conductive by carbon, copper sulfide, metal or metal oxide and it is winded around, or stuck to the cored bar which has been made conductive by metal and others to use as a charger.

The charger is not limited to above-mentioned contact chargers, however, it is preferable to use contact chargers because of the ability to decrease the ozone generated from charger in the image-forming apparatus.

Exposures may be performed by exposing the surface of photoconductor imagewise using exposure machines, for example.

The exposure machine is not limited as long as it is capable of exposing the surface of photoconductor that has been charged by a charger to form an image as it is expected, and may be selected accordingly. Examples thereof include various exposure machines such as copy optical system, rod lens array system, laser optical system, and liquid crystal shutter optical system, etc.

A backlight system may be employed in the invention by which the photoconductor is exposed imagewise from the rear surface.

-Developing and Developing Unit-

Developing is a step by which a latent electrostatic image is developed using toner and/or developer of the invention to form a visible image.

The visible image may be formed, for example, by developing a latent electrostatic image using toner and/or developer, which may be performed by a developing unit.

The developing unit is not limited as long as it is capable of developing an image by using toner and/or developer, for example, and may be selected from known developing unit accordingly. Examples thereof include those having developers that contain toners that can supply toners to the latent electrostatic images by contact or with no contact.

The developing unit may be of dry developing system or wet developing system and may also be for single or multiple colors. Preferred examples include one having mixer whereby toner and/or developer is charged by friction-stirring and rotatable magnet rollers.

In the developer, the toner and the carrier may, for example, be mixed and stirred together. The toner is thereby charged by friction, and forms a magnetic brush on the surface of the rotating magnet roller. Since the magnet roller is arranged near the photoconductor, a part of the toner constructing the magnetic brush formed on the surface of the magnet roller is moved toward the surface of the photoconductor due to the force of electrical attraction. As a result, a latent electrostatic image is developed by the use of toner, and a visible toner image is formed on the surface of the photoconductor.

The developer contained in the developing unit is the developer containing toner, and it may be one-component or two-component developer. The toner contained in the developer is the toner of the invention.

-Transferring and Transferring Unit-

Transferring is a step that transfers the visible image to a recording medium. In a preferable aspect, the first transferring is performed, using an intermediate transferring member by which the visible image is transferred to the intermediate transferring member, and the second transfer is performed wherein the visible image is transferred to the recording medium. In a more preferable aspect, toner of two or more colors and preferably of full-color and the configuration of which the first transferring is performed by transferring the visible image to the intermediate transferring member to form a compounded transfer image, and the second transferring is performed by transferring the compounded transfer image to the recording medium is employed.

Transferring of the visible image may be carried out, for example, by charging the photoconductor using a transferring charger, which can be performed by the transferring unit. In a preferable aspect, the transferring unit contains the first transferring unit which transfers the visible image to the intermediate transferring member to form a compounded transfer image, and the second transferring unit which transfers the compounded transfer image to the recording medium.

The intermediate transferring member is not limited and may be selected from known transferring members and preferred examples include transfer belts.

The stationary friction coefficient of intermediate transferring member is preferably 0.1 to 0.6 and more preferably 0.3 to 0.5. The volume resistance of intermediate transferring member is preferably more than several Ωcm and less than $10^3$ Ωcm. By keeping the volume resistance within a range of several Ωcm to $10^3$ Ωcm, the charge over intermediate transferring member itself can be prevented and the charge given by the charging unit is unlikely to remain on the intermediate transferring member. Therefore transfer nonuniformity at the time of secondary transferring can be prevented and the application of transfer bias at the time of secondary transferring becomes relatively easy.

The materials making up the intermediate transferring member is not particularly limited, and may be selected from know materials accordingly. Examples are named hereinafter. (1) Materials with high Young's modulus (tension elasticity) used as a single layer belt such as polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that registration error is least likely to occur during color image formation. (2) A double or triple layer belt using above-described belt having high Young's modulus as a base layer, added with a surface layer and an optional intermediate layer around the peripheral side of the base layer. The double or triple layer belt has a capability of preventing dropouts in a lined image that is caused by hardness of the single layer belt. (3) A belt with relatively low Young's modulus that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over rollers, it can prevent meandering of the belt. It is also cost effective for not requiring ribs or units to prevent meandering.

Conventionally, intermediate transfer belts have been adopting fluorine resins, polycarbonate resins, polyimide resins, and the like; however, recently, elastic belts in which elastic members are used in all layers or a part thereof are used as the intermediate transfer belts. There are some issues over transfer of color images by resin belt as described below.

Color images are typically formed by four colors of color toners. In one color image, toner layers of layer 1 to layer 4 are formed. Toner layers are pressurized as they pass through the primary transferring (in which toner is transferred to the intermediate transfer belt from the photoconductor) and the secondary transferring (in which toner is transferred to the sheet from the intermediate transfer belt), and the cohesive force among toner particles increases. As the cohesive force increases, phenomena such as dropouts of letters or dropouts of edges of solid images are likely to occur. Since resin belts are too hard to deform corresponding to the toner layers, they tend to compress the toner layers and therefore letter drop outs are likely to occur.

Recently, the demand toward printing full color images on various types of paper such as Japanese paper or the paper having a rough surface is increasing. However, the paper having a rough surface is likely to have a gap between toner and sheet at the time of transferring and therefore leading to transfer errors. When the transfer pressure of secondary transfer section is increased in order to increase adhesiveness, the cohesive force of the toner layers becomes high, resulting in the letter drop outs as described above.

Elastic belts are used for the following purpose. Elastic belts deform corresponding to the surface roughness of toner layers and the sheet having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter drop outs even with the paper of low flatness.

The resin of the elastic belts is not limited and may be selected accordingly. Examples thereof include polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. These may be used alone or in combination.

Rubber and elastomer of the elastic materials are not limited and may be selected accordingly. Examples thereof include butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (polystyrene elastomers, polyolefin elastomers, polyvinyl chloride elastomers, polyurethane elastomers, polyamide elastomers, polyurea elastomers, polyester elastomers, and fluorine resin elastomers), and the like. These may be used alone or in combination.

The conductive agents for resistance adjustment are not limited and may be selected accordingly. Examples thereof include carbon black, graphite, metal powders such as aluminum, nickel, and the like and electric conductive metal oxides such as tin oxide, titanium oxide, antimony oxide, indium oxide, potassium titanate, antimony tin oxide (ATO), indium tin oxide (ITO), and the like. The conductive metal oxides may be coated with insulating particles such as barium sulfate, magnesium silicate, calcium carbonate, and the like. The conductive agents are not limited to those mentioned above.

Materials of the surface layer are required to prevent contamination of the photoconductor by elastic material as well as to reduce the surface friction of the transfer belt so that toner adhesion is lessened while cleaning ability and the secondary transfer property are improved. Materials which reduces surface energy and enhances lubrication by the use of alone or combination of polyurethane, polyester, epoxy resin, and the like may be dispersed for use. Examples of such materials include alone, combination of two or more or combination of different particle diameters of powders or particles such as fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of manufacturing processes of the belts include, but not limited to centrifugal forming in which material is poured into a rotating cylindrical mold to form a belt, spray application in which a liquid paint is sprayed to form a film, dipping method in which a cylindrical mold is dipped into a solution of material and then pulled out, injection mold method in which material is injected between inner and outer mold, a method in which a compound is applied onto a cylindrical mold and the compound is vulcanized and grounded. In general, two or more processes are combined for manufacturing belts.

Methods to prevent elongation of the elastic belt include using a core resin layer that is difficult to elongate on which a rubber layer is formed, incorporating a material that prevents elongation into the core layer, and the like, but the methods are not particularly limited to the manufacturing processes.

Examples of the materials constructing the core layer that prevent elongation include alone or combination of natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials that are in a form of a weave or thread may be used. It should be noted that the materials are not limited to those described above.

A thread may be one or more of filaments twisted together, and any twisting and plying forms are accepted such as single twisting, multiple twisting, doubled yarn, and the like. Further, fibers of different materials selected from above-mentioned group may be spun together. The thread may be treated before use in such a way that it becomes electrically conductive. On the other hand, the weave may be of any type including plain knitting, and the like. It is possible to use a union weave for making it electrically conductive.

The manufacturing process of the core layer is not particularly limited. Examples include a method in which a weave that is woven in a cylindrical shape is placed on a mold or the like and a coating layer is formed on top of it, a method in which a cylindrical weave is dipped in a liquid rubber or the like so that coating layer(s) is formed on one side or on both sides of the core layer and a method in which a thread is wound helically to a mold or the like in an arbitrary pitch, and then a coating layer is formed thereon.

If the elastic layer is too thick, elongation and contraction of the surface becomes large and may cause cracks on the surface layer depending on the hardness of the elastic layer. Moreover, as the amount of elongation and contraction increases, the size of images are also elongated and contracted significantly. Therefore, too much thickness, about 1 mm or more, is not preferable.

The transferring units of the first and the second transferring preferably contain an image-transferring unit which releases the visible image formed on the photoconductor to the recording-medium side by charging. There may be one, two or more of the transferring unit.

The transferring unit may be a corona transferring unit based on corona discharge, transfer belt, transfer roller, pressure transfer roller, or adhesion transferring unit, for example.

The recording medium is not limited as long as it is capable of transferring unfixed images after development and may be selected accordingly. The recording medium is typically plain paper, and other materials such as polyethylene terephthalate (PET) sheets for overhead projector (OHP) may be utilized.

The fixing is a step that fixes the visible image transferred to the recording medium using a fixing unit. The fixing may be carried out for each color when being transferred to the recording medium, or simultaneously when all colors are being laminated.

The fixing unit is not limited and may be selected accordingly, however it is preferably known heat application and pressurization unit. Examples of such unit include a combination of heating roller and pressure roller, and a combination of heating roller, pressure roller, and endless belt, and the like.

The heating temperature in the heat application and pressurization unit is preferably 80° C. to 200° C. Further, known optical fixing unit may be used in addition to or in place of fixing and fixing unit, depending on the application.

The charge-eliminating is a step that applies a discharge bias to the photoconductor to discharge it, and may be performed by a charge-eliminating unit.

The charge-eliminating unit is not particularly limited as long as it is capable of applying discharge bias to the photoconductor such as discharge lamps, and may be selected from known charge-eliminating units accordingly.

The cleaning is a step in which residual electrophotographic toner on the latent electrostatic image bearing member is removed, and typically performed by a cleaning unit.

Any known cleaning unit that is capable of removing residual electrophotographic toner on the latent electrostatic image bearing member may be used and examples include magnetic brush cleaner, electrostatic brush cleaner, magnetic roller cleaner, blade cleaner, brush cleaner, and web cleaner, etc.

The recycling is a step in which the electrophotographic color toner removed by the cleaning is recycled for use in the developing, and typically performed by a recycling unit.

The recycling unit may be properly selected from known transport units.

The controlling is a step in which the respective processes are controlled and typically carried out by a controlling unit.

Any known controlling unit that is capable of controlling the performance of each unit may be selected accordingly. Examples include instruments such as sequencers or computers, etc.

Figure 2:
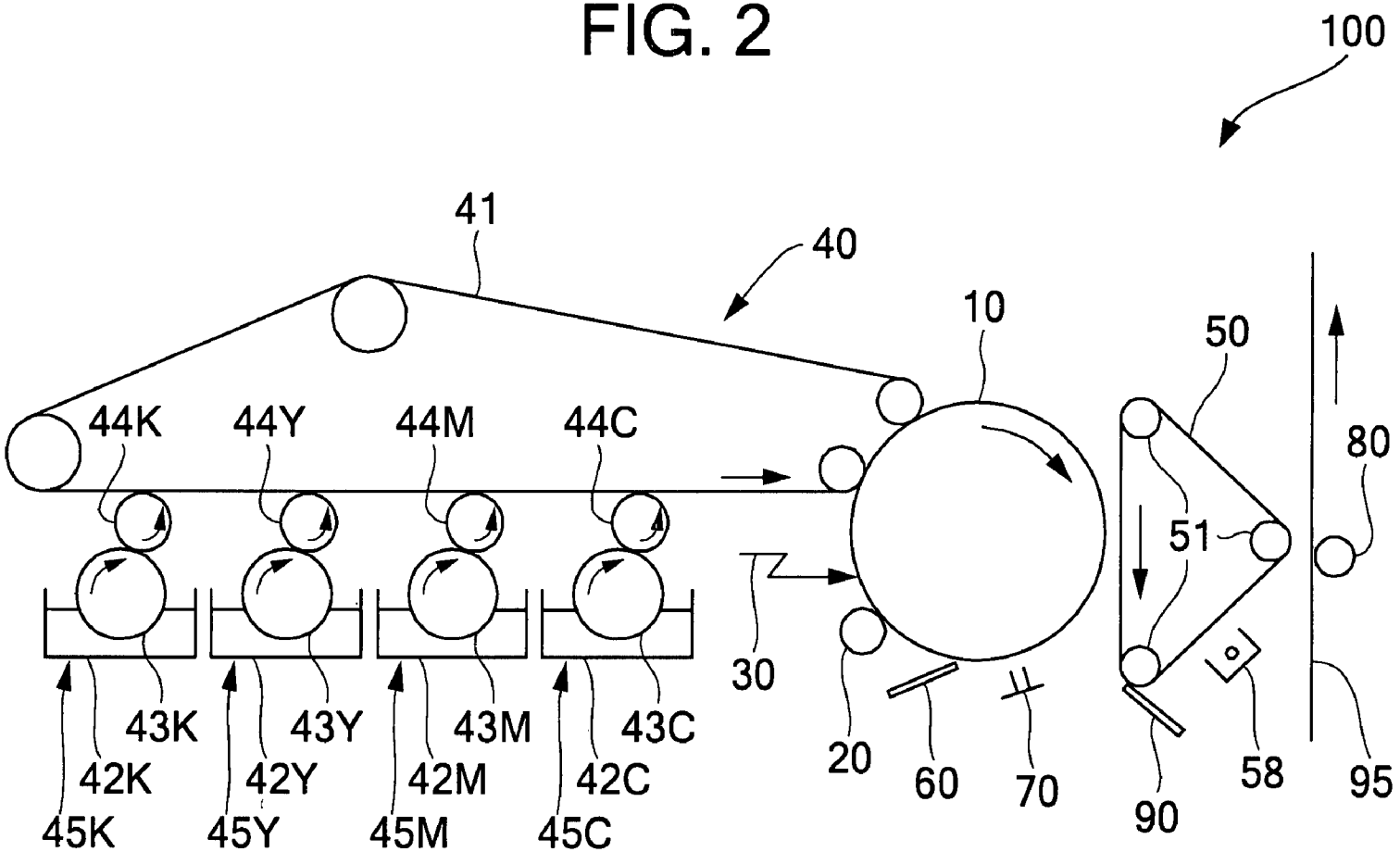
FIG. 2 is a schematic diagram of an example of the image forming apparatus of the present invention.

An aspect of the operation of the image forming process performed by the image forming apparatus of the invention is described referring to FIG. 2. The image forming apparatus 100 shown in FIG. 2 is equipped with the photoconductor drum 10 (hereafter referred to as "photoconductor 10") as a latent electrostatic image bearing member, the charge roller 20 as a charging unit, the exposure apparatus 30 as an exposure unit, the developing unit 40 as a developing unit, the intermediate transferring member 50, the cleaning unit 60 having a cleaning blade as a cleaning unit and the discharge lamp 70 as a discharging unit.

The intermediate transferring member 50 is an endless belt that is being extended by the three roller 51 placed inside the belt and designed to be moveable in arrow direction. A part of three roller 51 function as a transfer bias roller that can imprint a specified transfer bias, the primary transfer bias, to the intermediate transferring member 50. The cleaning unit 90 with a cleaning blade is placed near the intermediate transferring member 50, and the transfer roller 80, as a transferring unit which can imprint the transfer bias for transferring the developed image, toner image (second transferring), onto the transfer paper 95 as the final transfer material, is placed face to face with the cleaning unit 90. In the surrounding area of the intermediate transferring member 50, the corona charger 58, for charging toner image on the intermediate transferring member 50, is placed between contact area of the photoconductor 10 and the intermediate transferring member 50 and contact area of the intermediate transferring member 50 and the transfer paper 95 in the rotating direction of the intermediate transferring member 50.

The development apparatus 40 is constructed with developing belt 41 as a developer bearing member, black developing unit 45K, yellow developing unit 45Y, magenta developing unit 45M and cyan developing unit 45C that are juxtapositioned in the surrounding area of developing belt 41. The black developing unit 45K is equipped with developer container 42K, developer feeding roller 43K and developing roller 44K whereas yellow developing unit 45Y is equipped with developer container 42Y, developer feeding roller 43Y and developing roller 44Y. The magenta developing unit 45M is equipped with developer container 42M, developer feeding roller 43M and developing roller 44M whereas the cyan developing unit 45C is equipped with developer container 42C developer feeding roller 43C and developing roller 44C. The developing belt 41 is an endless belt and is extended between a number of belt rollers as rotatable and the part of developing belt 41 is in contact with the photoconductor 10.

For example, the charge roller 20 charges the photoconductor drum 10 evenly in the image forming apparatus 100 as shown in FIG. 2. The exposure apparatus 30 exposes imagewise on the photoconductor drum 10 and forms a latent electrostatic image. The latent electrostatic image formed on the photoconductor drum 10 is then developed with the toner fed from the developing unit 40 to form a toner image. The toner image is then transferred onto the intermediate transferring member 50 by the voltage applied from the roller 51 as the primary transferring and it is further transferred onto the transfer paper 95 as the secondary transferring. As a result, a transfer image is formed on the transfer paper 95. The residual toner on the photoconductor 10 is removed by the cleaning unit 60 and the charge built up over the photoconductor 10 is temporarily removed by the discharge lamp 70.

Figure 3:
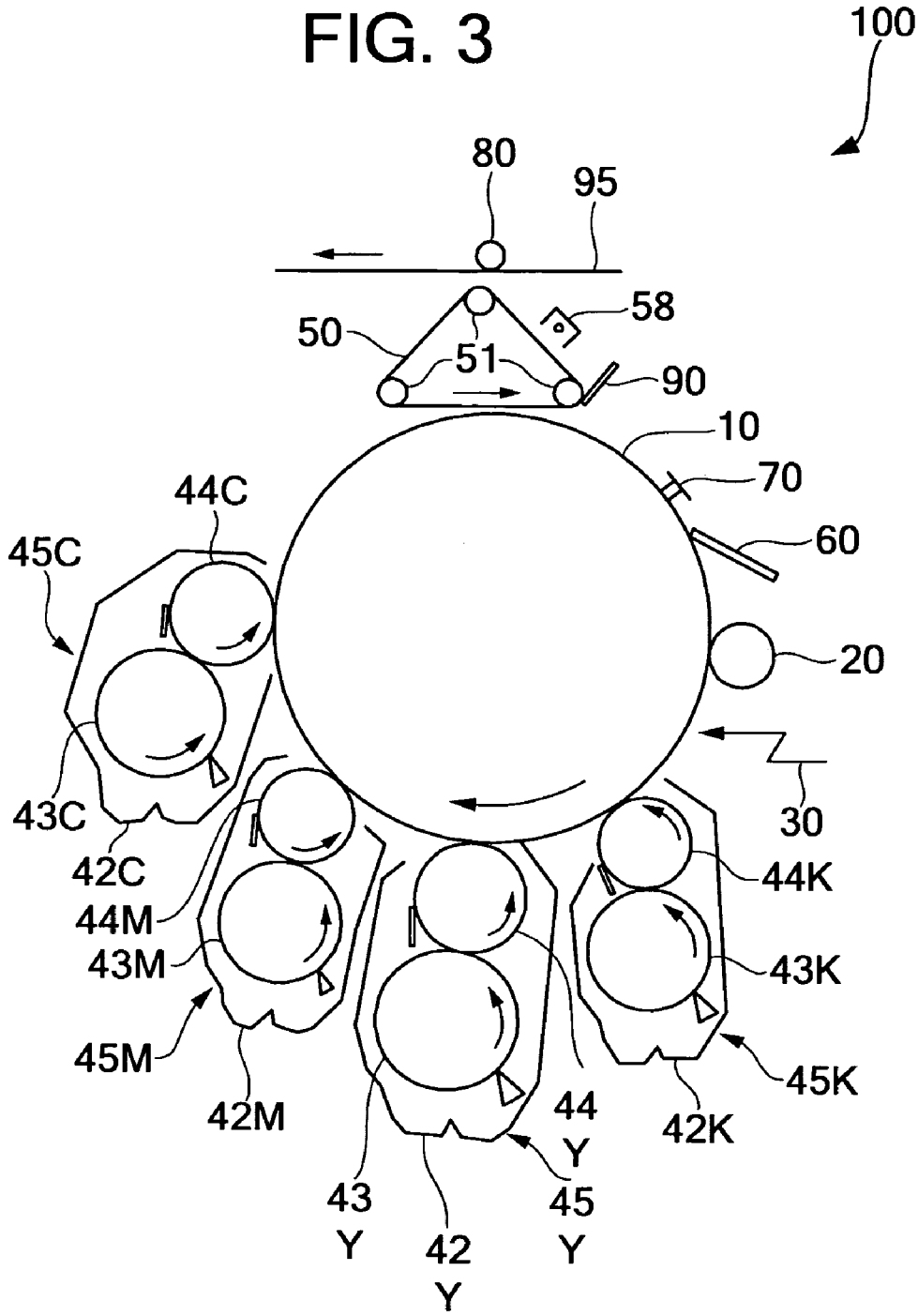
FIG. 3 is a schematic diagram of another example of the image forming apparatus of the present invention.

The other aspect of the operation of image forming processes of the invention by image forming apparatuses of the invention is described referring to FIG. 3. The image forming apparatus 100 as shown in FIG. 3 has the same lineups and effects as the image forming apparatus 100 shown in FIG. 2 except for the developing belt 41 is not equipped and the black developing unit 45K, the yellow developing unit 45Y, the magenta developing unit 45M and the cyan developing unit 45C are placed in the surrounding area directly facing the photoconductor 10. The symbols used in FIG. 3 correspond to the symbols used in FIG. 2.

Figure 4:
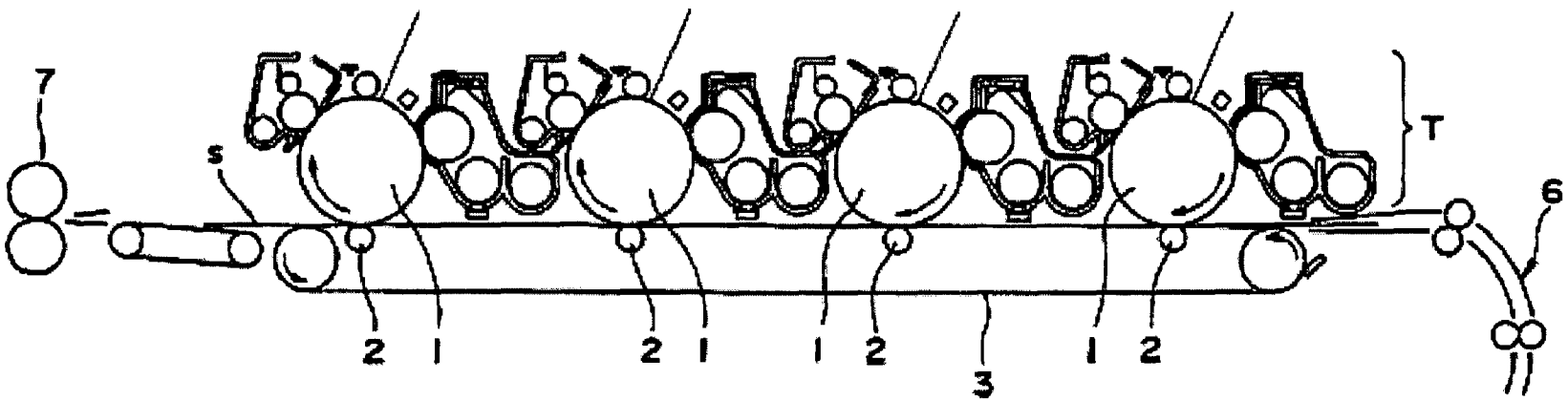
FIG. 4 is a schematic diagram of another example of the image forming apparatus of the present invention.
Figure 5:
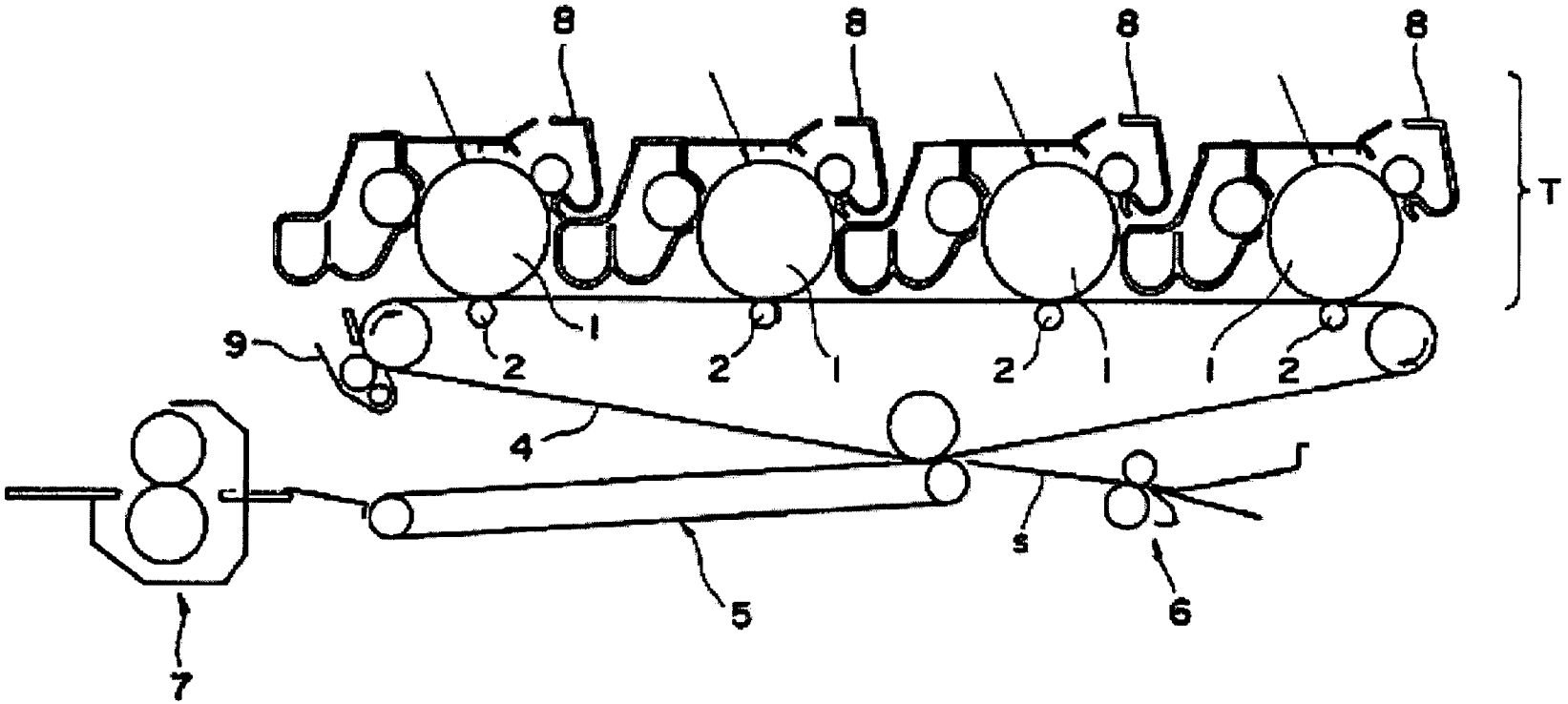
FIG. 5 is a schematic diagram of another example of the image forming apparatus of the present invention.

There are two types of tandem electrophotographic apparatus by which the image forming of the invention is performed by the image forming apparatus of the invention. In direct transfer type, images on the photoconductor 1 is transferred sequentially by the transferring unit 2 to the sheet "s" which is being transported by the sheet transport belt 3 as shown in FIG. 4. In the indirect transfer type, images on the photoconductor 1 is temporarily transferred sequentially by the primary transferring unit 2 to the intermediate transferring member 4 and then all the images on the intermediate transferring member 4 are transferred together to the sheet "s" by the secondary transferring unit 5 as shown in FIG. 5. The transferring unit 5 is generally a transfer/transport belt; however roller types may be used.

The direct transfer type, compared to the indirect transfer type, has a drawback of glowing in size because the paper feeding unit 6 must be placed on the upper side of the tandem image forming apparatus where the photoconductor 1 is aligned, whereas the fixing unit 7 must be placed on the lower side of the apparatus. On the other hand, in the indirect transfer type, the secondary transfer site may be installed relatively freely, and the paper feeding unit 6 and the fixing unit 7 may be placed together with the tandem image forming apparatus T making it possible to be downsized.

To avoid size-glowing in the direction of sheet transportation, the fixing unit 7 must be placed close to the tandem image forming apparatus T. However, it is impossible to place the fixing unit 7 in a way that gives enough space for sheet "s" to bend, and the fixing unit 7 may affect the image forming on the upper side by the impact generated from the leading end of the sheet "s" as it approaches the fixing unit 7 (this becomes distinguishable with a thick sheet), or by the difference between the transport speed of the sheet when it passes through the fixing unit 7 and when it is transported by the transfer/transport belt. The indirect transfer type, on the other hand, allows the fixing unit 7 to be placed in a way that gives sheet "s" an enough space to bend and the fixing unit 7 has almost no effect on the image forming.

For above reasons, the indirect transfer type of the tandem electrophotographic apparatus is particularly being emphasized recently.

And this type of color electrophotographic apparatus as shown in FIG. 5, prepares for the next image forming by removing the residual toner on the photoconductor 1 by the photoconductor cleaning unit 8 to clean the surface of the photoconductor 1 after the primary transferring. It also prepares for the next image forming by removing the residual toner on the intermediate transferring member 4 by the intermediate transferring member cleaning unit 9 to clean the surface of the intermediate transferring member 4 after the secondary transferring.

Figure 6:
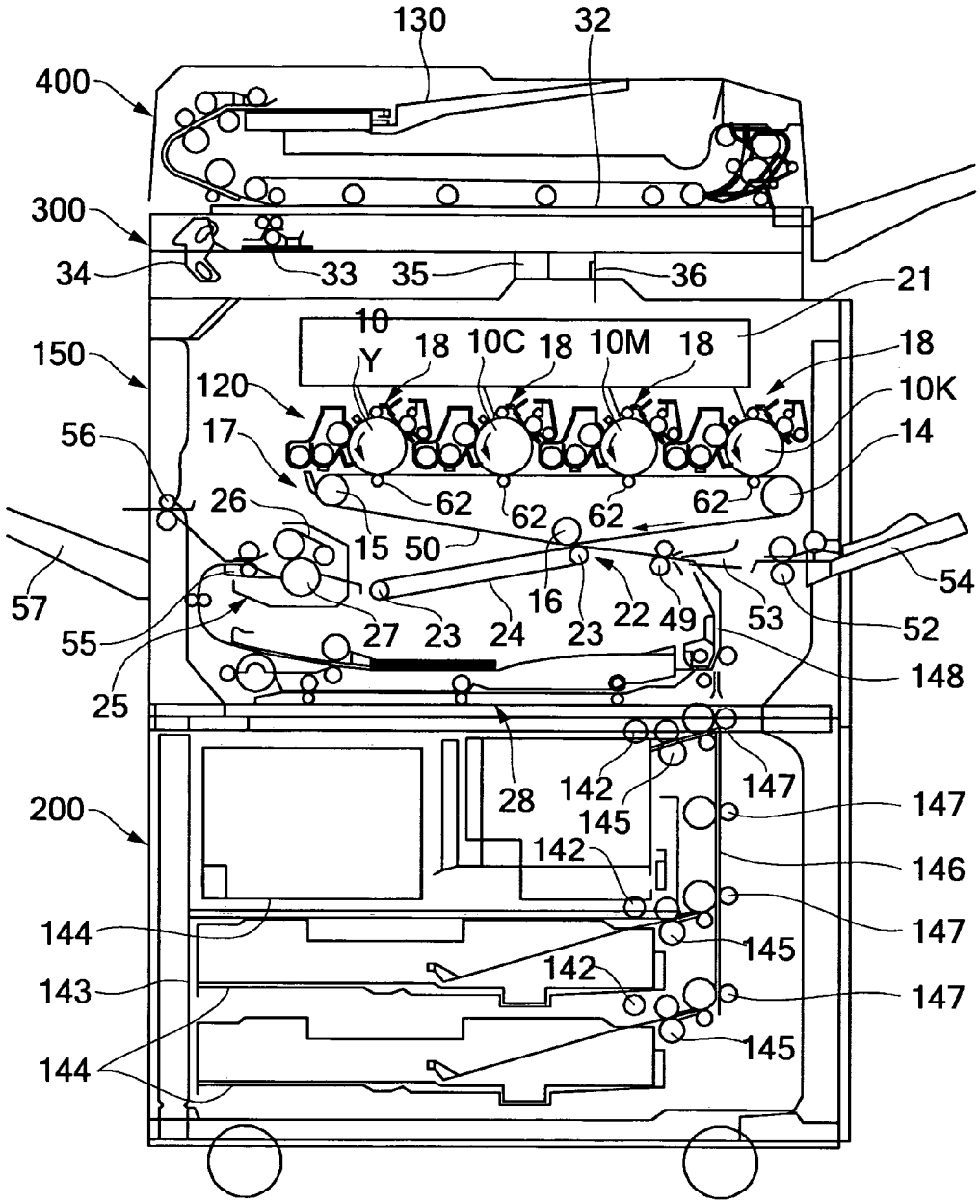
FIG. 6 is a schematic diagram of another example of the image forming apparatus of the present invention.

The tandem image forming apparatus 100 as shown in FIG. 6 is a tandem color image forming apparatus. The tandem image forming apparatus 120 is equipped with the copier main body 150, the feeding paper table 200, the scanner 300 and the automatic document feeder (ADF) 400.

The intermediate transferring member 50 in a form of an endless belt is placed in the center part of the copier main body 150. The intermediate transferring member 50 is extended between the support roller 14, 15 and 16 as rotatable in the clockwise direction as shown in FIG. 6. The intermediate transferring member cleaning unit 17 is placed near the support roller 15 in order to remove the residual toner on the intermediate transferring member 50. The tandem developing unit 120, in which four image forming unit 18, yellow, cyan, magenta and black, are positioned in line along the transport direction in the intermediate transferring member 50, which is being extended between the support roller 14 and 15. The exposure unit 21 is placed near the tandem developing unit 120. The secondary transferring unit 22 is placed on the opposite side where tandem developing unit 120 is placed in the intermediate transferring member 50. The secondary transfer belt 24, an endless belt, is extended between a pair of the roller 23 and the transfer paper transported on the secondary transfer belt 24 and the intermediate transferring member 50 are accessible to each other in the secondary transferring unit 22. The fixing unit 25 is placed near the secondary transferring unit 22.

The sheet inversion unit 28 is placed near the secondary transferring unit 22 and the fixing unit 25 in the tandem image forming apparatus 100, in order to invert the transfer paper to form images on both sides of the transfer paper.

The full-color image formation, color copy, using the tandem developing unit 120 is explained. At the start, a document is set on the document table 130 of the automatic document feeder (ADF) 400 or the automatic document feeder 400 is opened and a document is set on the contact glass 32 of the scanner 300 and the automatic document feeder 400 is closed.

By pushing the start switch (not shown in figures), the scanner 300 is activated after the document was transported and moved onto the contact glass 32 when the document was set on the automatic document feeder 400, or the scanner 300 is activated right after, when the document was set onto the contact glass 32, and the first carrier 33 and the second carrier 34 will start running. The light from the light source is irradiated from the first carrier 33 simultaneously with the light reflected from the document surface is reflected by the mirror of second carrier 34. Then the scanning sensor 36 receives the light via the imaging lens 35 and the color copy (color image) is scanned to provide image information of black, yellow, magenta and cyan.

Figure 7:
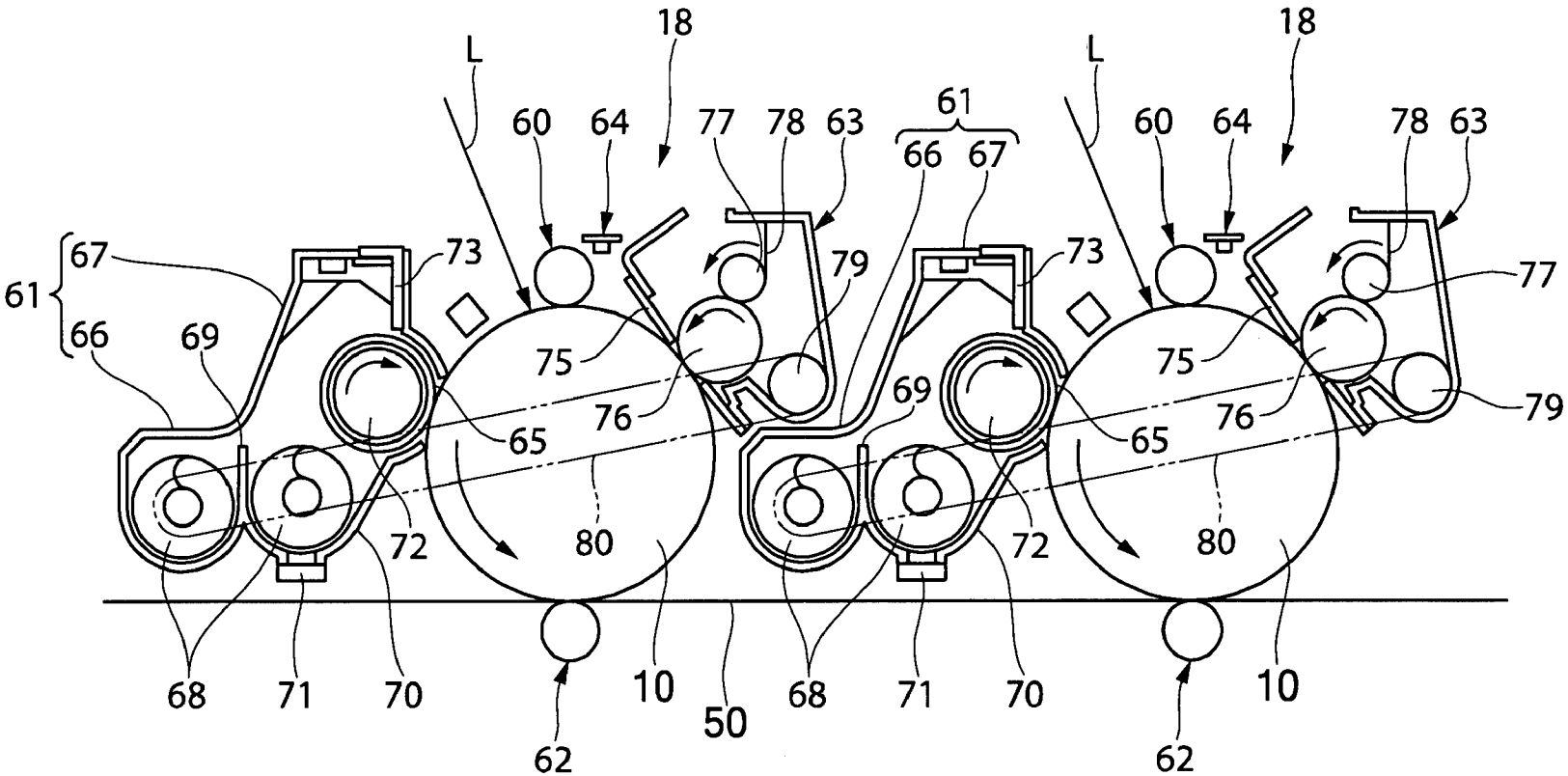
FIG. 7 is a schematic diagram of another example of the image forming apparatus of the present invention.

Each image information for black, yellow, magenta and cyan is transmitted to each image forming unit 18: black image forming unit, yellow image forming unit, magenta image forming unit and cyan image forming unit, of the tandem developing unit 120 and each toner image of black, yellow, magenta and cyan is formed in each image forming unit. The image forming unit 18: black image forming unit, yellow image forming unit, magenta image forming unit and cyan image forming unit of the tandem image forming apparatus 120 as shown in FIG. 7 is equipped with the photoconductor 10: photoconductor 10K for black, photoconductor 10Y for yellow, photoconductor 10M for magenta and photoconductor 10 C for cyan, the charger 60 that charges photoconductor evenly, an exposing unit by which the photoconductor is exposed imagewise corresponding to each color images based on each color image information as indicated by L in FIG. 7 to form a latent electrostatic image corresponding to each color image on the photoconductor, the developing unit 61 by which the latent electrostatic image is developed using each color toner: black toner, yellow toner, magenta toner and cyan toner to form toner images, the charge-transferring unit 62 by which the toner image is transferred onto the intermediate transferring member 50, the photoconductor cleaning unit 63 and the discharger 64. The image forming unit 18 is able to form each single-colored image: black, yellow, magenta and cyan images, based on each color image information. These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transferring member 50 which is being rotationally transported by the support rollers 14, 15 and 16 (the primary transferring). And the black, yellow, magenta and cyan images are overlapped to form a synthesized color image, a color transfer image.

In the feeding table 200, one of the feeding roller 142 is selectively rotated and sheets (recording paper) are rendered out from one of the feeding cassettes equipped with multiple-stage in the paper bank 143 and sent out to feeding path 146 after being separated one by one by the separation roller 145. The sheets are then transported to the feeding path 148 in the copier main body 150 by the transport roller 147 and are stopped running down to the resist roller 49. Alternatively, sheets (recording paper) on the manual paper tray 54 are rendered out by the rotating feeding roller 142, inserted into the manual feeding path 53 after being separated one by one by the separation roller 52 and stopped by running down to the resist roller 49. Generally, the resist roller 49 is used being grounded; however, it is also usable while bias is imposed for the sheet powder removal.

The resist roller 49 is rotated on the systhesized color image (color transfer image) on the intermediate transferring member 50 in a good timing, and a sheet (recording paper) is sent out between the intermediate transferring member 50 and the secondary transferring unit 22. The color image is then formed on the sheet (recording paper) by transferring (secondary transferring) the synthesized color image (color transfer image) by the secondary transferring unit 22. The residual toner on the intermediate transferring member 50 after the image transfer is cleaned by the intermediate transferring member cleaning unit 17.

The sheet (recording paper) on which the color image is transferred and formed is taken out by the secondary transferring unit 22 and sent out to the fixing unit 25 in order to fix the synthesized color image (color transfer image) onto the sheet (recording paper) under the thermal pressure. Triggered by the switch claw 55, the sheet (recording paper) is discharged by the discharge roller 56 and stacked on the discharge tray 57. Alternatively, triggered by the switch 55, the sheet is inverted by the sheet inversion unit 28 and led to the transfer position again. After recording an image on the reverse side, the sheet is then discharged by the discharge roller 56 and stacked on the discharge tray 57.

By applying toner that can sustain favorable transfer ability and cleaning ability for prolonged periods; prevent photoconductor filming; exhibit no variation in image nonuniformity or external additive immersion induced by developer agitation at the time of use; excels in stability with flowability and charge stability over prolonged periods, the image forming process and the image forming apparatus of the invention can produce high quality image effectively.

Conventional issues can be settled and a toner, a developer using toner, a toner container, a process cartridge, an image forming apparatus and an image forming process that can sustain favorable transferring ability and cleaning ability for prolonged periods; prevent photoconductor filming; exhibit no variation in image nonuniformity or external additive immersion induced by developer agitation at the time of use; excels in stability with flowability and charge stability over prolonged periods may be produced.

EXAMPLES

Herein below, with referring to Examples and Comparative Examples, the invention is explained in detail and the following Examples and Comparative Examples should not be construed as limiting the scope of this invention. All parts and % are expressed by mass unless indicated otherwise.

-Synthesis of Organic Particle Emulsion-

To a reaction vessel provided with stirrer and thermometer, 683 parts of water, 11 parts of sodium salt of sulfuric acid ester of methacrylic acid ethylene oxide adduct (ELEMINOL RS-30 by Sanyo Chemical Industries, Ltd.), 83 parts of styrene, 83 parts of methacrylic acid, 110 parts of butyl acrylate and 1 part of ammonium persulphate were introduced, and stirred at 3,800 rpm/min for 30 minutes to give a white emulsion. This was heated, the temperature in the system was raised to 75° C. and the reaction was performed for 4 hours. Next, 30 parts of an aqueous solution of 1% ammonium persulphate was added, and the reaction mixture was matured at 75° C. for 6 hours to obtain an aqueous dispersion of a vinyl resin (copolymer of methacrylic acid-butyl acrylate-sodium salt of sulfuric acid ester of methacrylic acid ethylene oxide adduct). This is referred to as "particle emulsion 1".

The volume average particle diameter of particles contained in the "particle emulsion 1" measured by the laser light scattering technique using LA-920 by Horiba Ltd. was 110 nm. After drying a part of the "particle emulsion 1", the resin was isolated. The glass-transition temperature, Tg of the resin was 58° C. and the average molecular mass, Mw was 130,000.

-Preparation of Aqueous Phase-

To 990 parts of water, 83 parts of the "particle emulsion 1," 37 parts of 48.3% aqueous solution of sodium dodecyl diphenylether disulfonic acid (ELEMINOL MON-7 by Sanyo Chemical Industries, Ltd.) and 90 parts of ethyl acetate were mixed and stirred together to obtain a milky liquid. This is referred to as "aqueous phase 1."

-Synthesis of Low Molecular Mass Polyester-

In a reaction vessel equipped with condenser tube, stirrer, and nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under normal pressure at 230° C. for 7 hours, and under a reduced pressure of 10 mmHg to 15 mmHg for 5 hours. Then 44 parts of anhydrous trimellitic acid was introduced into the reaction vessel, and the reaction was performed at 180° C. under normal pressure for 3 hours to obtain "low molecular mass polyester 1."

The "low molecular mass polyester 1" had a glass-transition temperature, Tg of 43° C., average molecular mass of 6,700, number average molecular mass of 2,300 and acid value of 25.

-Synthesis of Prepolymer-

In a reaction vessel equipped with condenser tube, stirrer, and nitrogen inlet tube, 682 parts of bisphenol A ethylene oxide dimolar adduct, 81 parts of bisphenol A propylene oxide dimolar adduct, 283 parts of terephthalic acid, 22 parts of trimellitic anhydride and 2 parts of dibutyl tin oxide were placed, and the reaction was performed under normal pressure at 230° C. for 7 hours and under a reduced pressure of 10 mmHg to 15 mmHg for 5 hours to obtain "intermediate polyester 1."

The "intermediate polyester 1" had a number average molecular mass of 2,200, average molecular mass of 9,700, glass-transition temperature, Tg of 54° C., acid value of 0.5 and hydroxyl value of 52.

In a reaction vessel equipped with condenser tube, stirrer, and nitrogen inlet tube, 410 parts of "intermediate polyester 1", 89 parts of isophorone diisocyanate and 500 parts of ethyl acetate were placed, and the reaction was performed at 100° C. for 5 hours to obtain "prepolymer 1."

The free isocyanate % by mass of "prepolymer 1" was 1.53%.

-Synthesis of Ketimine-

Into a reaction vessel equipped with stirrer and thermometer, 170 parts of isohorone diamine and 75 parts of methyl ethyl ketone were introduced, and the reaction was performed at 50° C. for 4 and a half hours to obtain "ketimine compound 1." The amine value of "ketimine compound 1" was 417.

-Synthesis of Masterbatch (MB)-

1,200 parts of water, 540 parts of carbon black (Printex 35 by Degussa AG) [DBP oil absorption amount=42 ml/100 mg, pH-9.5] and 1,200 parts of polyester resin (RS801 by Sanyo Chemical Industries, Ltd.) were added and mixed in HENSCHEL MIXER (by Mitsui Mining). Then the mixture was kneaded at 110° C. for 1 hour using two rollers, and subjected to rolling-cooling and crushed with a pulverizer to obtain carbon black masterbatch. This is referred to as "masterbatch 1".

-Preparation of Oil Phase- 378 parts of "low molecular mass polyester 1", 100 parts of carnauva wax and 947 parts of ethyl acetate were introduced into a reaction vessel provided with stirrer and thermometer, and the temperature was raised to 80° C. with stirring, maintained at 80° C. for 5 hours, and cooled to 30° C. over 1 hour. Next, 500 parts of "masterbatch 1" and 500 parts of ethyl acetate were introduced into the reaction vessel and mixed for 1 hour to obtain a lysate. This is referred to as "raw material solution 1".

1,324 parts of "raw material solution 1" were transferred to a reaction vessel, and carbon black and wax were dispersed using a bead mill (Ultra Visco Mill by Aimex Co., Ltd.) under the condition of liquid feed rate 1 kg/hr, disk circumferential speed 6 m/sec, 0.5 mm zirconia beads packed to 80% by volume and 3 passes.

Next, 1,324 parts of 65% ethyl acetate solution of the "low molecular mass polyester 1" was added and dispersed in 2 pass by the bead mill under the aforesaid condition to obtain a dispersion. This is referred to as "pigment/wax dispersion 1".

The solid concentration of "pigment/wax dispersion 1" (130° C., 30 minutes) was 50%.

-Emulsification- 749 parts of "pigment/wax dispersion 1", 115 parts of "prepolymer 1" and 2.9 parts of "ketimine compound 1" were placed in a reaction vessel and mixed at 5,000 rpm for 2 minutes using TK homomixer by Tokushu Kika Kogyo Co., Ltd. Then 1,200 parts of "aqueous phase 1" were added to the reaction vessel and mixed in the TK homomixer at a rotation speed of 13,000 rpm for 25 minutes to obtain an aqueous medium dispersion.

This is referred to as "emulsion slurry 1".

-Organic Solvent Removal-

The "Emulsion slurry 1" was placed in a reaction vessel equipped with stirrer and thermometer, then the solvent was removed at 30° C. for 8 hours and the product was matured at 45° C. for 4 hours to obtain dispersion of which organic solvent is removed. This is referred to as "dispersion slurry 1."

-Rinsing and Drying-

After filtering 100 parts of "dispersion slurry 1" under the reduced pressure, rinsing and drying processes were performed by following procedures.

(1) 100 parts of ion exchange water were added to the filter cake and mixed in a TK homomixer at a rotation speed of 12,000 rpm for 10 minutes and filtered.

(2) 100 parts of 10% sodium hydroxide solution were added to the filter cake of (1) and mixed in a TK homomixer at a rotation speed 12,000 rpm for 30 minutes and filtered under the reduced pressure.

(3) 100 parts of 10% hydrochloric acid were added to the filter cake of (2) and mixed in a TK homomixer at a rotation speed 12,000 rpm for 10 minutes and filtered.

(4) 100 parts of ion exchange water and 0.1% of aqueous solution of fluorochemical surfactant based on the solid content of the cake were added to the filter cake of (3) and mixed in a TK homomixer at a rotation speed 12,000 rpm for 10 minutes and filtered.

(5) 300 parts of ion exchange water were added to the filter cake of (4) and mixed in a TK homomixer at a rotation speed 12,000 rpm for 10 minutes and filtered twice to obtain a filter cake.

The filter cake was then dried in a circulating air dryer at 45° C. for 48 hours, and sieved through a sieve of 75 μm mesh to obtain a toner-base particle. This is referred to as "toner-base particle 1".

The volume average particle diameter (Dv), particle size distribution (Dv/Dn) and average circularity of "toner-base particle 1" were measured using Coulter Electronics Coulter Counter model TA-II by Coulter Electronics Ltd.

The volume average particle diameter (Dv) was 5.8 μm, particle size distribution (Dv/Dn) was 1.15 and average circularity was 0.950.

-The Volume Average Particle Diameter (Dv) and Particle Size Distribution (Dn)-

The volume average particle diameter and particle size distribution of a toner at an aperture diameter of 100 μm was measured using a particle size meter, Coulter Electronics Coulter Counter model TA-II by Coulter Electronics Ltd. And the figure of volume average particle diameter/number average particle diameter was calculated based on the result.

<Average Circularity>

The average circularity of the toner was measured by a flow type particle image analyzer, FPIA-2100 by Sysmex Corporation. Specifically, the measurement was performed by adding 0.1 ml to 0.5 ml of alkylbenzene sulfonate surfactant as a dispersing agent to 100 ml to 150 ml of water from which solid impurities had been removed in advance, in a container, and then 0.1 g to 0.5 g of each toner was added and dispersed. The dispersion was subjected to dispersion treatment for 1 minute to 3 minutes using an ultrasonic disperser by Honda Electronics, and the toner shapes and distribution were measured by the above apparatus at a dispersion concentration of 3,000 μl to 10,000 μl and the average circularity was calculated from the result above.

-Carrier Production- 200 parts of toluene, 200 parts of silicone resin (SR 2400 by Dow Corning Toray Silicone Co., Ltd., non-volatile portion 50%), 7 parts of aminosilane (SH 6020 by Dow Corning Toray Silicone Co., Ltd.) and 4 parts of carbon black were dispersed with a stirrer for 10 minutes to prepare a coating liquid.

The coating liquid and 5,000 parts of Mn ferrite particles as a core material with a mass average particle diameter of 35 μm were poured into a coating apparatus equipped with a rotating base plate disk and stirring blades in a fluidized bed to form a whirling flow to conduct coating and the coating liquid was applied onto the core material. The coated material was then baked in an electric oven at 250° C. for 2 hours to prepare a carrier.

-External Additive Preparation-

The surface-treated external additives A to L as described in Table 1 were prepared by a conventional method.

TABLE 1

| | Inorganic Particle | Average Diameter | Surface Treatment Agent | |
|---|---|---|---|---|
| Additive A | silica | 10 nm | methyl-trimethoxy-silane | — |
| Additive B | silica | 12 nm | hexamethyl-disilazane | — |
| Additive C | titanium oxide | 10 nm | methyl-trimethoxy-silane | — |
| Additive D | titanium oxide | 15 nm | isobutyl-trimethoxy-silane | — |
| Additive E | titanium oxide | 15 nm | methyl-trimethoxy-silane | perfluoropropyl-trimethoxysilane |
| Additive F | silica | 80 nm | hexamethyl-disilazane | — |
| Additive G | silica | 120 nm | hexamethyl-disilazane | — |
| Additive J* | silica | 10 nm | hexamethyl-disilazane | — |
| Additive K* | silica | 100 nm | hexamethyl-disilazane | — |
| Additive L* | silica | 140 nm | hexamethyl-disilazane | — |

In Table 1, external additives J*, K* and L* are external additives that contain a large quantity of aggregates themselves.

-External Additive Aggregates Production- 100 parts of mixed solution of water and methanol with a ratio of 10:90 was added to 100 parts of external additive F of Table 1. This was left undisturbed and dried simultaneously for 24 hours in a beaker and then dried for 24 hours under reduced pressure to produce fine particles. This was cracked in a mortar and sieved through a stainless steel sieve of 45 μm mesh and the particles that passed through the sieve were referred to as "external additive aggregates H".

The "external additive aggregates I" was produced by the same procedure using the external additive G of Table 1.

Examples 1 to 6 and Comparative Example 1

-Toner Production-

The external additives 1, 2 and 3 and aggregates were added to 100 parts of the "toner-base particle 1" according to the amount of formula shown in Table 2 and stirred in HENSCHEL MIXER. The fine particles produced after stirring was then sieved through a sieve of 100 μm mesh and coarse particles were eliminated to produce toner A to G.

TABLE 2

| | Additive 1 | Amount in parts | Additive 2 | Amount in parts | Additive 3 | Amount in parts | Aggregates | Amount in parts |
|---|---|---|---|---|---|---|---|---|
| Toner A | A | 0.5 | D | 0.5 | F | 1.0 | H | 0.1 |
| Toner B | B | 0.75 | C | 0.75 | F | 1.0 | H | 0.1 |
| Toner C | B | 1.0 | D | 0.5 | F | 1.0 | H | 0.1 |
| Toner D | B | 1.0 | E | 0.5 | F | 1.0 | H | 0.1 |
| Toner E | B | 1.5 | D | 0.75 | G | 1.0 | I | 0.1 |
| Toner F | B | 1.5 | D | 0.75 | G | 1.0 | I | 0.1 |
| Toner G | B | 2 | D | 0.5 | F | 1.5 | H | 5.0 |

The quantity of external additive aggregates in the toner was measured for each toner obtained in Examples 1 to 6 and Comparative Example 1 as follow. The results are shown in Table 3.

<Quantity Measurement of External additive Aggregates>

0.2 g of each toner was weighed on a V-blowing cell, a sieve of 635-mesh and 452 $cm^2$ of mesh area, and blasted at 0.2 MPa of blow pressure from 160 mm above the cell while air-sucking at 5 mmHg of suction force to remove toner. Additional removal of toner was then performed by air-sucking at 20 mmHg of suction force. If the toner removal was incomplete, the same procedure was taken in succession to complete the toner removal. The residuals on the sieve were then observed by digital microscope (KEYENCE VHX-100) at 150 magnifications. The quantity of aggregate (white aggregate particles of about 30 μm) of residual additives on the sieve was counted. 4 to 20-scope measurement was made to obtain the quantity of aggregate of external additives contained in the toner.

TABLE 3

| | | |
|---|---|---|
| Example 1 | Toner A | 38 |
| Example 2 | Toner B | 92 |
| Example 3 | Toner C | 36 |
| Example 4 | Toner D | 44 |
| Example 5 | Toner E | 1221 |
| Example 6 | Toner F | 81 |
| Comparative Example 1 | Toner G | 5684 |

Example 7

-Toner Preparation- 1 part of the external additive F was added to 100 parts of the "toner-base particle 1" and stirred by HENSCHEL MIXER at a circumferential velocity of 40 m/s for 10 minutes. Next, 0.5 parts of the external additive A and 0.5 parts of the external additive D were added to the mixture and stirred by HENSCHEL MIXER at a circumferential velocity of 60 m/s for 10 minutes. The coarse particles were then removed by sieving the fine particles produced after mixing through a sieve of 100 μm mesh to produce toner H of Example 7.

Example 8

-Toner Preparation- 1 part of the external additive K was added to 100 parts of produced "toner-base particle 1" and stirred by HENSCHEL MIXER at a rotating speed of 40 m/s for 10 minutes. Next, 0.5 parts of the external additive J and 0.5 parts of the external additive D were added to the mixture and stirred by HENSCHEL MIXER at a rotating speed of 40 m/s for 10 minutes. The coarse particles were then removed by sieving the fine particles produced after mixing through a sieve with 100 μm mesh to produce toner I of Example 8.

Example 9

-Toner Preparation-

One part of the external additive L was added to 100 parts of the "toner-base particle 1" and stirred by HENSCHEL MIXER at a circumferential velocity of 45 m/s for 10 minutes. Next, 1 part of the external additive B and 0.5 parts of the external additive C were added to the mixture and stirred by HENSCHEL MIXER at a circumferential velocity of 40 m/s for 10 minutes. The coarse particles were then removed by sieving the fine particles produced after mixing through a sieve of 100 μm mesh to produce toner J of Example 9.

Comparative Example 2

-Toner Preparation- 1 part of the external additive J and 1 part of the external additive D were added to 100 parts of the "toner-base particle 1" and stirred by HENSCHEL MIXER at a circumferential velocity d of 30 m/s for 8 minutes. The coarse particles were then removed by sieving the fine particles produced after mixing through a sieve of 100 μm mesh to produce toner K of Comparative Example 2.

Comparative Example 3

-Toner Preparation- 1 part of the external additive J and 0.5 parts of the external additive D were added to 100 parts of the "toner-base particle 1" and stirred by HENSCHEL MIXER at a circumferential velocity of 30 m/s for 10 minutes. Next, 1 part of the external additive L was added to the mixture and stirred by HENSCHEL MIXER at a circumferential velocity of 40 m/s for 5 minutes. The coarse particles were then removed by sieving the fine particles produced after mixing through a sieve of 100 μm mesh to produce toner L of Comparative Example 3.

Comparative Example 4

The toner M of Comparative Example 4 was prepared similar to Example 1 disclosed in JP-A No. 2001-66820.

Example 10

-Toner Preparation- 683 parts of water, 11 parts of sodium salt of sulfuric acid ester of methacrylic acid ethylene oxide adduct (ELEMINOL RS-30 by Sanyo Chemical Industries, Ltd.), 138 parts of styrene, 138 parts of methacrylic acid and 1 part of ammonium persulphate were introduced to a reaction vessel provided with stirrer and thermometer, and stirred at 400 rpm/min for 15 minutes to give a white emulsion. This was heated to the temperature in the system of 75° C. and the reaction was performed for 5 hours. Next, 30 parts of an aqueous solution of 1% ammonium persulphate was added, and the reaction mixture was matured at 75° C. for 5 hours to obtain an aqueous dispersion of a vinyl resin (copolymer of styrene-methacrylic acid-sodium salt of sulfuric acid ester of methacrylic acid ethylene oxide adduct) organic particles emulsion. The volume average particle diameter of the dispersion measured by LA-920 by HORIBA Ltd. was 0.14 μm. A part of the dispersion was then dried and the resin was isolated. The glass transition temperature, Tg of the resin was 152° C.

Next, 200 parts of above-mentioned ethyl acetate solution of polyester resin, 5 parts of carnauba wax and 4 parts of copper phthalocyanine blue pigment were introduced in a sealed pot and ball mill dispersion was performed for 24 hours using zirconia beads with a diameter of 5 mm. Then 20 parts in solid content conversion of isocyanate-contained polyester was added and stirred to produce a toner composition. 600 parts of ion exchange water, 48 parts of aqueous dispersion of organic particle emulsion, 24 parts of 48.5% aqueous solution of sodium dodecylphenylether disulfonic acid (Eleminol MON-7 by Sanyo Chemical Industries Co.) and 36 parts of ethyl acetate were mixed and stirred in a beaker to obtain a milky white liquid.

Next, 1 part of ketimine compound of which mixed oil phase was prepared right before emulsion was poured into the above-mentioned toner composition while sustaining the temperature inside the beaker at 20° C. and stirring at 12,000 rpm by TK homomixer by Tokushu Kika Kogyo Co., Ltd., and emulsification by stirring was performed for 3 minutes. And then the mixed solution was transferred to a flask equipped with a stirring rod and thermometer and the solvent was removed at 30° C. under 50 mmHg of reduced pressure for 8 hours.

Ethyl acetate in the dispersion was confirmed to be 100 ppm or less by gas-chromatography. The dispersion was then filtered and obtained cake was again dispersed in distillated water and filtered. The cake was then washed after this procedure was performed in succession for 3 times. Obtained cake was again dispersed in distillated water so as to have a solid content of 10% and the dispersion of base particle was produced.

Dv of produced base particle was 5.81 μm, Dv/Dn was 1.15, shape factor SF-1 was 110 and shape factor SF-2 was 115.

Next, silica particles A thru C with properties shown in Table 4 obtained by the metal alcoxide hydrolysis polycondensation were prepared.

TABLE 4

| | Variation Factor | SF-1 | Volume Average Particle Distribution |
|---|---|---|---|
| Silica Particle A | 26 | 112 | 120 nm |
| Silica Particle B | 55 | 115 | 110 nm |
| Silica Particle C | 35 | 135 | 125 nm |

Next, 3 parts of silica particle A was gradually added to the solution containing 0.2 parts of N,N,N,-trimethyl-[3-(4-perfluorononenyl oxybenzoneamide) propyl] ammonium iodide (product name: Ftergent by Neos Chemical Ltd.), 70 parts of ion exchange water and 30 parts of methanol while stirring to produce dispersion of silica particles. Produced dispersion of silica particles are mixed with the dispersion of base particles and then stirred at a room temperature for 1 hour and filtered and separated. Produced cake was then dried under reduced pressure at 40° C. for 24 hours to produce toner particles. Each silica particles were attached uniformly to the surface of produced base particles as it was observed by a scanning electron microscope, SEM. This is referred to as "toner particle A".

0.5 parts of hydrophobic silica, R972 by Nippon Aerosil Co., Ltd. and 0.5 parts of hydrophobic titanium oxide, MT150AI by Titan Kogyo Kabushiki Kaisha were mixed with 100 parts of the "toner particle A" by Henschel mixer to produce toner N.

Example 11

-Toner Preparation-

Toner O of Example 11 was produced similarly to Example 10 except for using silica particle B shown in Table 4 instead of using silica particle A.

Example 12

-Toner Preparation-

Toner P of Example 12 was produced similarly to Example 10 except for using silica particle C shown in Table 4 instead of using silica particle A.

The quantity of external additive aggregates was measured for each toner produced in Example 7 to 12 and Comparative Example 2 to 4, similarly to Example 1 to 6 and Comparative Example 1.

TABLE 5

| | Toner | Quantity of Additive Aggregates |
|---|---|---|
| Example 7 | Toner H | 181 |
| Example 8 | Toner I | 1248 |
| Example 9 | Toner J | 58 |
| Comparative Example 2 | Toner K | 4652 |
| Comparative Example 3 | Toner L | 6420 |
| Comparative Example 4 | Toner M | 4803 |
| Example 10 | Toner N | 112 |
| Example 11 | Toner O | 86 |
| Example 12 | Toner P | 34 |

-Developer Preparation- 7 parts of each toner produced in Examples 1 thru 12 and Comparative Example 1 thru 4 and 100 parts of carrier are mixed uniformly and charged by a tubular mixer of which the container is rolled for agitation to produce developer.

The produced developer was then loaded to the image-forming apparatus, IPSiO Color 8100 by Ricoh Company, Ltd. to output images and the result was evaluated as shown in Table 6.

<Image Density>

After solid images were produced at a low adhesive amount of 0.3±0.1 mg/cm$^2$ on the transfer paper of a standard paper (type 6200 by Ricoh Company, Ltd.), image density was measured using X-Rite by X-Rite Incorporated. The image density of 1.4 or more was indicated as "A" and the image density of less than 1.4 was indicated as "D".

<Cleaning Ability>

The transfer residual toner on the photoconductor, after passing through the cleaning process following 1,000 chart of 95% image-area ratio, was transferred onto a blank sheet with a scotch tape by Sumitomo 3M Ltd.

The transferred residual toner was then measured by Macbeth reflection densitometer RD 514 and the result was evaluated in accordance with the standards shown below.

[Evaluation Standards]

A: the difference from the blank sheet is less than 0.005
B: the difference form the blank sheet is 0.005 to 0.010
C: the difference from the blank sheet is 0.011 to 0.02
D: the difference from the blank sheet is more than 0.02

<Transfer Property>

After transferring the chart of 20% image-area ratio from the paper onto the photoconductor, the transfer residual toner on the photoconductor right before cleaning was transferred onto a blank sheet using a scotch tape by Sumitomo 3M Ltd. The transferred residual toner was then measured by Macbeth reflection densitometer RD 514 and the result was evaluated in accordance with the standards shown below.

[Evaluation Standards]

A: the difference from the blank sheet is less than 0.005
B: the difference form the blank sheet is 0.005 to 0.010
C: the difference from the blank sheet is 0.011 to 0.02
D: the difference from the blank sheet is more than 0.02

<Image Graininess and Fineness>

A single-colored photographic image was produced and the degree of graininess and fineness were observed with eyes and evaluated in accordance with the standards shown below.

[Evaluation Standards]

A: comparable to offset printing
B: slightly inferior to offset printing
C: considerably inferior to offset printing
D: greatly inferior to conventional electrophotographic images <Fog>

After performing output-endurance test of 100,000 chart of 5% image-area ratio using each toner at the temperature of 10° C. and humidity of 15% RH by a remodeled oilless-fixing image-forming apparatus, IPSiO Color 8100 by Ricoh Co., Ltd., degree of residual toner on the background of the transfer paper was observed with eyes using loupe and evaluated in accordance with the standards shown below.

[Evaluation Standards]

A: no residual toner is observed in an appropriate condition
B: slight residual toner that count for nothing
C: small amount of residual toner
D: amount exceeds tolerance level posing a problem <Toner Scattering>

After performing output-endurance test of 100,000 chart of 5% image-area ratio using each toner at the temperature of 40° C. and humidity of 90% RH by a remodeled oilless-fixing image-forming apparatus, IPSiO Color 8100 by Ricoh Co., Ltd., the condition of residual toner on the background of the transfer paper was observed with eyes using loupe and evaluated in accordance with the standards shown below.

[Evaluation Standards]

A: no residual toner is observed in an appropriate condition
B: slight residual toner that count for nothing
C: small amount of residual toner
D: amount exceeds tolerance level posing a problem <Charge Stability>

An output-endurance test of continuance 100,000 character image pattern of 12% image-area ratio for each toner was performed and the degree of charge variation was evaluated. A small amount of developer was extracted from the sleeve and the degree of charge variation was obtained by a blow-off method and evaluated in accordance with the standards shown below.

B: charge variation is less than 5 μc/g
C: charge variation is 5 μc/g or more and 10 μc/g or less
D: charge variation is more than 10 μc/g <Filming>

The degree of filming on the development roller and the photoconductor, after outputting 1,000 bar charts of 50%, 75% and 100% image-area ratio, was observed and evaluated in accordance with the standards shown below.

A: no filming is observed
B: slight filming is observed
C: filming in lines
D: filming in entire surface

TABLE 6

| | Toner | Image Density | Cleaning Ability | Transfer Property | Graininess | Fog | Toner Scattering | Charge Stability | Filming |
|---|---|---|---|---|---|---|---|---|---|
| Example 1 | Toner A | A | B | C | C | C | C | C | A |
| Example 2 | Toner B | A | B | B | B | C | B | C | A |
| Example 3 | Toner C | A | B | B | B | B | B | B | B |
| Example 4 | Toner D | A | B | B | B | B | B | B | A |
| Example 5 | Toner E | A | A | A | A | A | A | A | C |
| Example 6 | Toner F | A | A | A | A | A | A | A | B |
| Comparative Example 1 | Toner G | D | D | C | D | D | C | C | D |
| Example 7 | Toner H | A | B | C | A | B | B | C | A |
| Example 8 | Toner I | A | B | A | A | C | C | A | B |
| Example 9 | Toner J | A | B | A | A | B | B | B | A |
| Comparative Example 2 | Toner K | D | D | D | D | C | C | C | D |
| Comparative Example 3 | Toner L | D | C | D | D | D | D | D | D |
| Comparative Example 4 | Toner M | D | C | D | C | D | D | D | D |
| Example 10 | Toner N | A | B | C | B | B | B | A | A |
| Example 11 | Toner O | A | B | B | A | B | B | A | A |
| Example 12 | Toner P | A | A | A | A | B | B | A | A |

The toner of the present invention can sustain favorable transferability and cleaning ability for prolonged periods; prevent photoconductor filming; exhibit no variation in image nonuniformity or external additive immersion induced by developer agitation at the time of use; excels in stability with flowability and charge stability over prolonged periods and is suitable for use in the high-quality image forming.

The developer using toner of the present invention, toner container, process cartridge, image forming apparatus and image forming method may be suitably used for the high-quality image forming.

What is claimed is:

1. A toner comprising:

an external additive, wherein the external additive comprises large diameter particles and small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

2. The toner according to claim 1, wherein the quantity of aggregate of residual external additives on the sieve is 4,500 or less and 20 or more.

3. The toner according to claim 1, wherein the quantity of aggregate of residual external additives on the sieve is 3,000 or less and 30 or more.

4. The toner according to claim 1, wherein the volume average particle diameter of the large diameter particles is 80 μm to 250 μm.

5. The toner according to claim 1, wherein the large diameter particles are added prior to the addition of the small diameter particles.

6. The toner according to claim 1, wherein the large diameter particles are silica particles and the small diameter particles are at least one of titanium oxide particles and hydrophobic silica particles.

7. The toner according to claim 1, wherein the volume average particle diameter of the toner is 3 μm to 8 μm.

8. The toner according to claim 1, wherein the ratio of the volume average particle diameter (Dv) to the number average particle diameter (Dn) is 1.25 or less.

9. The toner according to claim 1, wherein the average circularity of the toner is 0.900 to 0.980.

10. The toner according to claim 1, wherein the external additive and a toner particle are mixed and the external additive is attached to the toner particle.

11. The toner according to claim 1, wherein the external additive and the toner particle are dispersed in an aqueous medium and the external additive is attached to the toner particle.

12. The toner according to claim 1, wherein the external additive, the aggregates of large diameter particles and the toner particle are mixed and the external additive and the aggregates are attached to the toner particle.

13. The toner according to claim 1, wherein the content of the large diameter particles is less than the content of the small diameter particles.

14. The toner according to claim 1, wherein the toner is obtained by:

dissolving and/or dispersing toner materials including an active hydrogen group-containing compound and a polymer that is reactive with the active hydrogen group-containing compound in an organic solvent to form a toner solution;

emulsifying and/or dispersing the toner solution in an aqueous medium to prepare a dispersion;

reacting the active hydrogen group-containing compound with the polymer that is reactive with the active hydrogen group-containing compound in the aqueous medium to granulate adhesive base materials; and removing the organic solvent.

15. A developer comprising:

a toner, wherein the toner comprising:

an external additive, wherein the external additive comprises large diameter particles and small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

16. A toner container comprising:

a toner, wherein the toner comprising:

an external additive, wherein the external additive comprises large diameter particles and small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

17. A process cartridge comprising:

a latent electrostatic image bearing member, and a developing unit configured to develop a latent electrostatic image on the latent electrostatic image bearing member using a toner to form a visible image, wherein the toner comprising:

an external additive, wherein the external additive comprises large diameter particles and small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

18. An image forming method comprising:

forming a latent electrostatic image on a latent electrostatic image bearing member, and developing the latent electrostatic image using a toner to form a visible image, and transferring the visible image onto a recording medium, and fixing the transferred image on the recording medium, wherein the toner comprising:

an external additive, wherein the external additive comprises the large diameter particles and the small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

19. An image forming apparatus comprising:

a latent electrostatic image bearing member, a latent electrostatic image forming unit configured to form the latent electrostatic image on the latent electrostatic image bearing member, and a developing unit configured to develop the latent electrostatic image using the toner to form a visible image, and a transferring unit configured to transfer the visible image onto a recording medium, and a fixing unit configured to fix the transferred image on the recording medium, wherein the toner comprising:

an external additive, wherein the external additive comprises the large diameter particles and the small diameter particles of which a volume average particle diameter is smaller than that of the large diameter particles, and wherein the quantity of aggregate of residual external additives found on the sieve of 635-mesh and 452 $cm^2$ of mesh area, after 0.2 g of the toner on the sieve is blasted with air at a blow pressure of 0.2 MPa from 160 mm above the sieve while being air-suctioned at a suction force of 5 mmHg, and then air-suctioned at a suction force of 20 mmHg, is 4,500 or less and 5 or more.

* * * * *